US009949047B2

(12) United States Patent
Ryu

(10) Patent No.: US 9,949,047 B2
(45) Date of Patent: Apr. 17, 2018

(54) METHOD FOR CONTROLLING AUDIO SIGNAL AND ELECTRONIC DEVICE SUPPORTING THE SAME

(71) Applicant: Samsung Electronics Co., Ltd., Gyeonggi-do (KR)

(72) Inventor: Heejun Ryu, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 15/331,234

(22) Filed: Oct. 21, 2016

(65) Prior Publication Data

US 2017/0127203 A1 May 4, 2017

(30) Foreign Application Priority Data

Oct. 29, 2015 (KR) ..... 10-2015-0150914

(51) Int. Cl.

*H04R 29/00* (2006.01)
*H04R 3/12* (2006.01)
*H04R 5/04* (2006.01)

(52) U.S. Cl.

CPC ..... *H04R 29/001* (2013.01); *H04R 3/12* (2013.01); *H04R 5/04* (2013.01); *H04R 2420/05* (2013.01); *H04R 2499/11* (2013.01)

(58) Field of Classification Search

CPC ..... H04R 29/001; H04R 3/12; H04R 2420/09
See application file for complete search history.

(56) References Cited

U.S. PATENT DOCUMENTS

| | | | | |
|---|---|---|---|---|
| 7,949,802 | B2 * | 5/2011 | Gallant | G06F 13/4081 710/300 |
| 8,369,548 | B2 | 2/2013 | Lin | |
| 8,831,234 | B2 * | 9/2014 | Turner | H03K 5/1254 381/58 |
| 9,064,062 | B2 * | 6/2015 | Kruiskamp | G06F 13/4291 |
| 2017/0111742 | A1 * | 4/2017 | Forman | H04R 5/04 |
| 2017/0150270 | A1 * | 5/2017 | Chang | G06F 3/165 |

OTHER PUBLICATIONS

Univeral Serial Bus Type-C Cable and Connector Specification, Revision 1.1 Apr. 3, 2015, Copyright 2015 Promoter Group, pp. 180.

* cited by examiner

*Primary Examiner* — Brenda C Bernardi
(74) *Attorney, Agent, or Firm* — The Farrell Law Firm, P.C.

(57) ABSTRACT

An electronic device is provided including a housing, an opening formed on a side of the housing, a hole connected to the opening, a receptacle disposed inside the hole, having a structure for receiving an external connector, and comprising a plurality of pins, a memory, a processor electrically coupled to the memory, and a circuit electrically coupled to the processor and the receptacle. When the external connector is inserted into the receptacle, the circuit may receive at least one of a signal and a current through at least one of the pins, and selects one of a plurality of audio signal processing methods provided to the external connector through the receptacle based on at least one of the received signal and the current.

20 Claims, 25 Drawing Sheets

METHOD FOR CONTROLLING AUDIO SIGNAL AND ELECTRONIC DEVICE SUPPORTING THE SAME

PRIORITY

This application claims priority under 35 U.S.C. § 119(a) to Korean Patent Application Serial No. 10-2015-0150914, which was filed in the Korean Intellectual Property Office on Oct. 29, 2015, the entire content of which is incorporated herein by reference.

BACKGROUND

1. Field of the Disclosure

The present disclosure generally relates to an audio signal controlling method and an electronic device supporting the same.

2. Description of the Related Art

With recent advances in digital technologies, various electronic devices such as smart phones, tablet personal computers (PCs), personal digital assistants (PDAs), electronic notebooks, wearable devices, or televisions (TVs) are widely used. Such an electronic device provides various interfaces for data transfer and supports wired or wireless data communications (e.g., transmission or reception) between electronic devices using an interface configured for the electronic devices. For example, the electronic device provides an interface for wirelessly exchanging data based on short-range communication such as Bluetooth, wireless fidelity (WiFi), and near field communication (NFC), and an interface for exchanging data using a wired cable such as universal serial bus (USB).

The USB 3.1 Type-C standard (hereafter, referred to as a USB Type-C interface) has been released and commercialized. The USB Type-C interface supports four analog audio signals in a USB Type-C connector as in an existing 3.5 tip ring ring sleeve (TRRS) headphone jack and thus allows analog audio signals.

However, the released USB Type-C interface standard supports only unbalanced stereo audio output. As a result, a separate plug (e.g., an X-Series connector with latch and rubber (XLR) connector) is used to output a balanced stereo audio signal through the USB Type-C interface.

SUMMARY

An aspect of the present disclosure provides an audio signal controlling method for supporting both balanced audio signal output and microphone signal output and identifying various audio adaptor accessories connected to an electronic device, and the electronic device for supporting the same.

Another aspect of the present disclosure provides an audio signal controlling method for supporting dual channel stereo audio signal output or 4-channel audio signal output, and an electronic device for supporting the same.

Another aspect of the present disclosure provides an audio signal controlling method for supporting a universal serial bus (USB)/audio switch structure which is simplified and capable of preventing performance degradation, and an electronic device for supporting the same.

Another aspect of the present disclosure provides an electronic device which includes a housing, an opening formed on a side of the housing, a hole connected to the opening, a receptacle disposed inside the hole, having a structure for receiving an external connector, and including a plurality of pins, a memory, a processor electrically coupled to the memory, and a circuit electrically coupled to the processor and the receptacle. When the external connector is inserted into the receptacle, the circuit receives at least one of a signal and a current through at least one of the pins, and selects one of a plurality of audio signal processing methods provided to the external connector through the receptacle based on at least one of the received signal and the current.

According to another aspect of the present disclosure, a method includes, when an external connector is inserted into a receptacle and includes a plurality of pins, receiving at least one of a signal and a current through at least one of the pins, and selecting one of a plurality of audio signal processing methods provided to the external connector through the receptacle based on at least one of the received signal and the current.

BRIEF DESCRIPTION OF THE DRAWINGS

The above and other aspects, features, and advantages of the present disclosure will be more apparent from the following description taken in conjunction with the accompanying drawings, in which.

DETAILED DESCRIPTION

Figure 1:
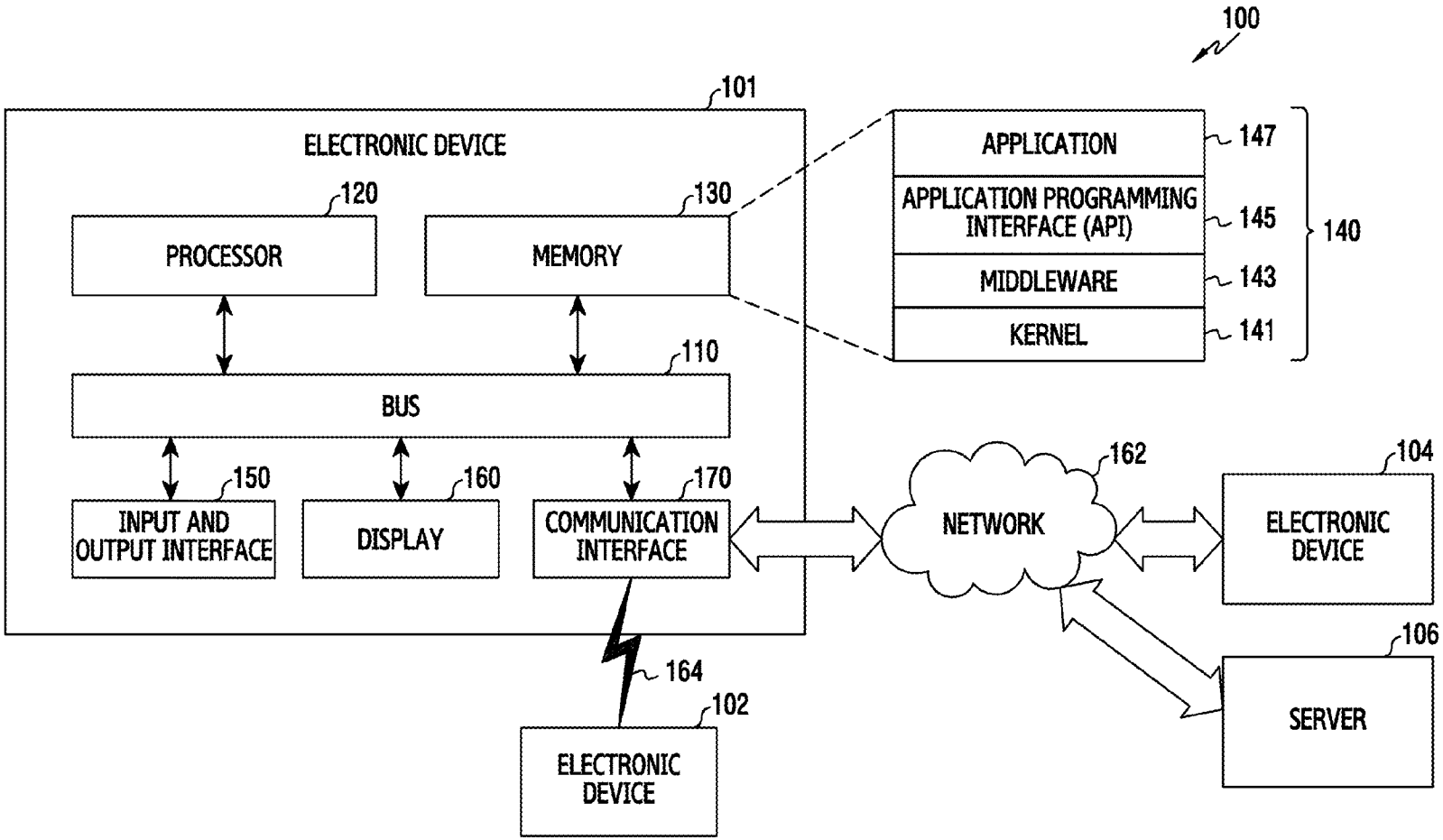
FIG. 1 is a diagram of a network including an electronic device according to an embodiment of the present disclosure.

Hereinafter, an embodiment of the present disclosure will be described with reference to the accompanying drawings. However, it should be understood that there is no limiting the present disclosure to the particular forms disclosed herein; rather, the present disclosure should be construed to cover various modifications, equivalents, and/or alternatives of embodiments of the present disclosure. In describing the drawings, similar reference numerals may be used to designate similar constituent elements.

As used herein, the expressions "have", "may have", "include", or "may include" refer to the existence of a corresponding feature (e.g., numeral, function, operation, or constituent element such as component), and do not exclude one or more additional features.

In the present disclosure, the expressions "A or B", "at least one of A or/and B", or "one or more of A or/and B" may include all possible combinations of the items listed. For example, the expressions "A or B", "at least one of A and B", or "at least one of A or B" refer to all of (1) including at least one A, (2) including at least one B, or (3) including both at least one A and at least one B.

The expressions "a first", "a second", "the first", or "the second" used in an embodiment of the present disclosure may modify various components regardless of the order and/or the importance but do not limit the corresponding components. For example, a first user device and a second user device indicate different user devices although both of them are user devices. For example, a first element may be referred to as a second element, and similarly, a second element may be referred to as a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposed between them. In contrast, it may be understood that when an element (e.g., first element) is referred to as being "directly connected," or "directly coupled" to another element (second element), there are no elements (e.g., third element) interposed between them.

The expression "configured to" used in the present disclosure may be used interchangeably with, for example, "suitable for", "having the capacity to", "designed to", "adapted to", "made to", or "capable of", according to the situation. The term "configured to" may not necessarily imply "specifically designed to" in hardware. Alternatively, in some situations, the expression "device configured to" may mean that the device, together with other devices or components, "is able to". For example, the phrase "processor adapted (or configured) to perform A, B, and C" may mean a dedicated processor (e.g. embedded processor) only for performing the corresponding operations or a general-purpose processor (e.g., central processing unit (CPU) or application processor (AP)) that may perform the corresponding operations by executing one or more software programs stored in a memory device.

The terms used herein are merely for the purpose of describing particular embodiments and do not limit the scope of other embodiments. As used herein, singular forms may include plural forms as well unless the context clearly indicates otherwise. Unless defined otherwise, all terms used herein, including technical and scientific terms, have the same meaning as those commonly understood by a person skilled in the art to which the present disclosure pertains. Such terms as those defined in a generally used dictionary may be interpreted to have the same meanings as the contextual meanings in the relevant field of art, and are not to be interpreted to have ideal or excessively formal meanings unless clearly defined in the present disclosure. In some cases, even the terms defined in the present disclosure should not be interpreted to exclude embodiments of the present disclosure.

An electronic device according to an embodiment of the present disclosure may include at least one of, for example, a smart phone, a tablet personal computer (PC), a mobile phone, a video phone, an electronic book reader (e-book reader), a desktop PC, a laptop PC, a netbook computer, a workstation, a server, a personal digital assistant (PDA), a portable multimedia player (PMP), an MPEG-1 audio layer-3 (MP3) player, a mobile medical device, a camera, and a wearable device. The wearable device may include at least one of an accessory type (e.g., a watch, a ring, a bracelet, an anklet, a necklace, a glasses, a contact lens, or a head-mounted device (HMD)), a fabric or clothing integrated type (e.g., an electronic clothing), a body-mounted type (e.g., a skin pad, or tattoo), and a bio-implantable type (e.g., an implantable circuit).

According to an embodiment of the present disclosure, the electronic device may be a home appliance. The home appliance may include at least one of, for example, a television, a digital video disk (DVD) player, an audio player, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

According to an embodiment of the present disclosure, the electronic device may include at least one of various medical devices (e.g., various portable medical measuring devices (a blood glucose monitoring device, a heart rate monitoring device, a blood pressure measuring device, a body temperature measuring device, etc.), a magnetic resonance angiography (MRA), a magnetic resonance imaging (MRI), a computed tomography (CT) machine, and an ultrasonic machine), a navigation device, a global positioning system (GPS) receiver, an event data recorder (EDR), a flight data recorder (FDR), a vehicle infotainment devices, an electronic device for a ship (e.g., a navigation device for a ship, and a gyro-compass), avionics, security devices, an automotive head unit, a robot for home or industry, an automatic teller machine (ATM), point of sales (POS) terminal, or Internet of Things (IoT) devices (e.g., a light bulb, various sensors, electric or gas meter, a sprinkler device, a fire alarm, a thermostat, a streetlamp, a toaster, a sporting goods, a hot water tank, a heater, a boiler, etc.).

According to an embodiment of the present disclosure, the electronic device may include at least one of a part of furniture or a building/structure, an electronic board, an electronic signature receiving device, a projector, and various kinds of measuring instruments (e.g., a water meter, an electric meter, a gas meter, and a radio wave meter). The electronic device may be a combination of one or more of the aforementioned various devices. The electronic device may be a flexible device. Further, the electronic device is not limited to the aforementioned devices, and may include a new electronic device according to the development of new technology.

Hereinafter, an electronic device according to an embodiment of the present disclosure will be described with reference to the accompanying drawings. As used herein, the term "user" may indicate a person who uses an electronic device or a device (e.g., an artificial intelligence electronic device) that uses an electronic device.

FIG. 1 illustrates a network environment including an electronic device according to an embodiment of the present disclosure.

An electronic device 101 within a network environment 100, according to an embodiment of the present disclosure, will be described with reference to FIG. 1. The electronic device 101 includes a bus 110, a processor 120, a memory 130, an input/output interface 150, a display 160, and a communication interface 170. In an embodiment of the present disclosure, the electronic device 101 may omit at least one of the above elements or may further include other elements.

The bus 110 may include, for example, a circuit for connecting the elements 110-170 and transferring communication (e.g., control messages and/or data) between the elements.

The processor 120 may include one or more of a central processing unit (CPU), an application processor (AP), and a communication processor (CP). The processor 120, for example, may carry out operations or data processing relating to control and/or communication of at least one other element of the electronic device 101.

The memory 130 may include a volatile memory and/or a non-volatile memory. The memory 130 may store, for example, instructions or data relevant to at least one other element of the electronic device 101. The memory 130 stores software and/or a program 140. The program 140 includes, for example, a kernel 141, middleware 143, an application programming interface (API) 145, and/or application programs (or "applications") 147. At least some of the kernel 141, the middleware 143, and the API 145 may be referred to as an operating system (OS).

The kernel 141 may control or manage system resources (e.g., the bus 110, the processor 120, or the memory 130) used for performing an operation or function implemented by the other programs (e.g., the middleware 143, the API 145, or the application programs 147). Furthermore, the kernel 141 may provide an interface through which the middleware 143, the API 145, or the application programs 147 may access the individual elements of the electronic device 101 to control or manage the system resources.

The middleware 143, for example, may function as an intermediary for allowing the API 145 or the application programs 147 to communicate with the kernel 141 to exchange data.

In addition, the middleware 143 may process one or more operation requests received from the application program 147 according to priority. For example, the middleware 143 may give priority to use the system resources of the electronic device 101 (for example, the bus 110, the processor 120, the memory 130, and the like) to at least one of the application programs 147. For example, the middleware 143 may perform scheduling or load balancing with respect to the one or more operation requests by processing the one or more operation requests according to the priority given to the at least one application program.

The API 145 is an interface through which the applications 147 control functions provided from the kernel 141 or the middleware 143, and may include, for example, at least one interface or function (e.g., instruction) for file control, window control, image processing, or text control.

The input/output interface 150, for example, may function as an interface that may transfer instructions or data input from a user or another external device to the other element(s) of the electronic device 101. Furthermore, the input/output interface 150 may output the instructions or data received from the other element(s) of the electronic device 101 to the user or another external device.

The display 160 may include, for example, a liquid crystal display (LCD), a light emitting diode (LED) display, an organic light emitting diode (OLED) display, a micro electro mechanical system (MEMS) display, or an electronic paper display. The display 160, for example, may display various types of content (e.g., text, images, videos, icons, or symbols) for the user. The display 160 may include a touch screen and receive, for example, a touch, gesture, proximity, or hovering input using an electronic pen or the user's body part.

The communication interface 170, for example, may set communication between the electronic device 101 and the first external electronic device 102, the second external electronic device 104, or a server 106. For example, the communication interface 170 may be connected to a network 162 through wireless or wired communication to communicate with the second external electronic device 104 or the server 106.

The wireless communication may use at least one of, for example, long term evolution (LTE), LTE-Advance (LTE-A), code division multiple access (CDMA), wideband CDMA (WCDMA), universal mobile telecommunications system (UMTS), WiBro (Wireless Broadband), and global system for mobile communications (GSM), as a cellular communication protocol. In addition, the wireless communication may include, for example, short range communication 164. The short-range communication 164 may be performed by using at least one of, for example, Wi-Fi, Bluetooth, Bluetooth low energy (BLE), near field communication (NFC), and global navigation satellite system (GNSS). The GNSS may include at least one of, for example, a global positioning system (GPS), a global navigation satellite system (Glonass), a Beidou navigation satellite system (Beidou), and a European global satellite-based navigation system (Galileo), according to a use area, a bandwidth, and the like. Hereinafter, in the present disclosure, the term "GPS" may be interchangeably used with the term "GNSS". The wired communication may include at least one of, for example, a universal serial bus (USB), a high definition multimedia interface (HDMI), recommended standard 232 (RS-232), and a plain old telephone service (POTS). The network 162 may include at least one of a communication network such as a computer network (e.g., a LAN or a WAN), the Internet, and a telephone network.

Each of the first and second external electronic devices 102 and 104 may be of a type identical to or different from that of the electronic device 101. The server 106 may include a group of one or more servers. All or some of the operations performed in the electronic device 101 may be performed in another electronic device or the electronic devices 102 and 104 or the server 106. When the electronic device 101 has to perform some functions or services automatically or in response to a request, the electronic device 101 may make a request for performing at least some functions relating to the electronic device 102 or 104 or the server 106 instead of performing the functions or services by itself or in addition. Another electronic device may execute the requested functions or the additional functions, and may deliver a result of the execution to the electronic device 101. The electronic device 101 may process the received result as it is or additionally to provide the requested functions or services. To achieve this, for example, cloud computing, distributed computing, or client-server computing technology may be used.

Figure 2:
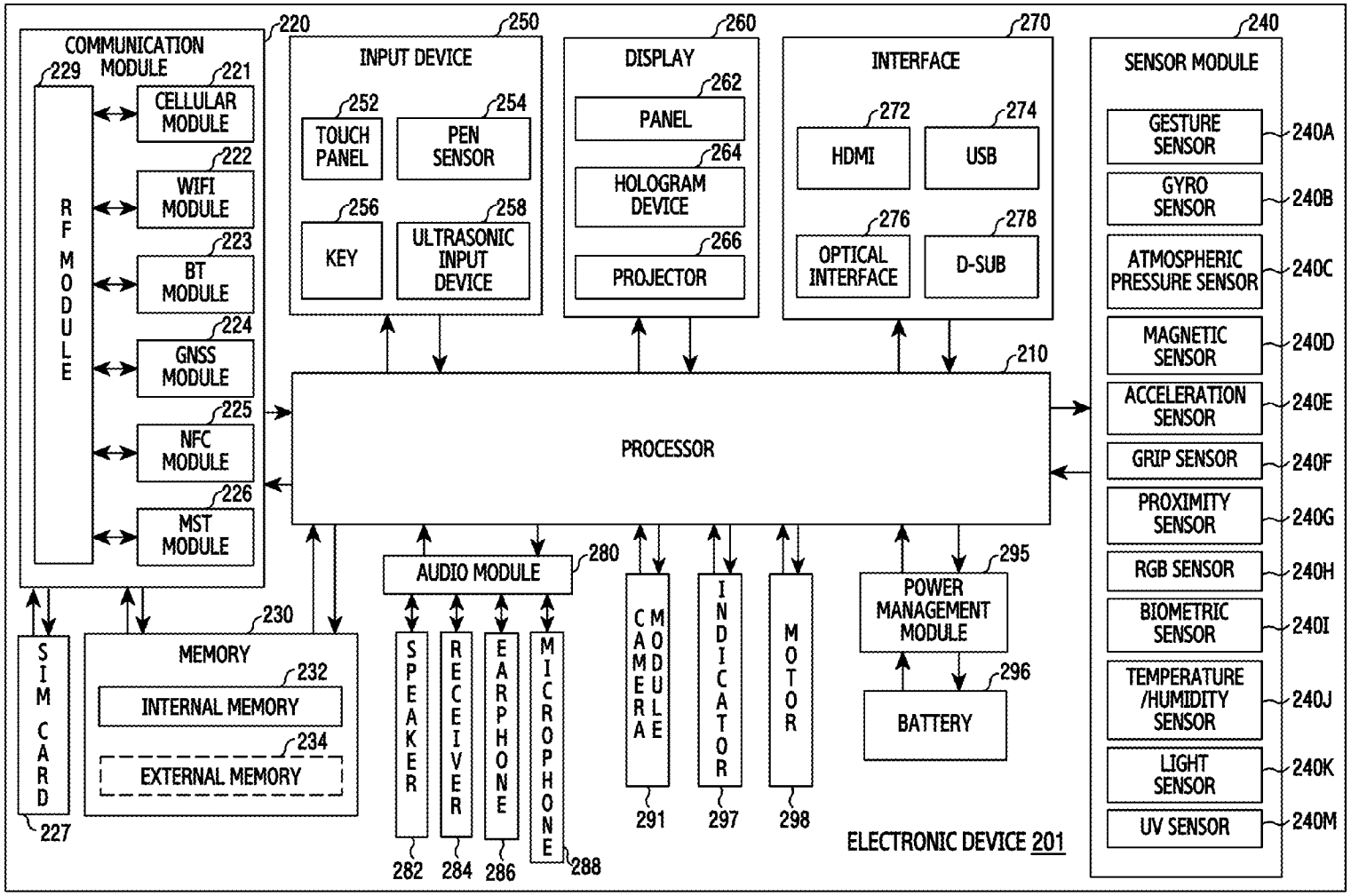
FIG. 2 is a block diagram of an electronic device according to an embodiment of the present disclosure.

FIG. 2 is a block diagram of an electronic device according to an embodiment of the present disclosure. For example, the electronic device 201 may include all or part of the electronic device 101 illustrated in FIG. 1. The electronic device 201 includes at least one processor (e.g., application processor (AP)) 210, a communication module 220, a subscriber identification module (SIM) 227, a memory 230, a sensor module 240, an input device 250, a display 260, an interface 270, an audio module 280, a camera module 291, a power management module 295, a battery 296, an indicator 297, and a motor 298.

The processor 210 may control a plurality of hardware or software components connected to the processor 210 by driving an operating system or an application program and perform processing of various pieces of data and calculations. The processor 210 may be implemented by, for example, a system on chip (SoC). According to an embodiment, the processor 210 may further include a graphic processing unit (GPU) and/or an image signal processor. The processor 210 may include at least some (e.g., a cellular module 221) of the elements illustrated in FIG. 2. The processor 210 may load, into a volatile memory, instructions or data received from at least one (e.g., a non-volatile memory) of the other elements and may process the loaded instructions or data, and may store various data in a non-volatile memory.

The communication module 220 may have a configuration equal or similar to that of the communication interface 170 of FIG. 1. The communication module 220 may include, for example, the cellular module 221, a Wi-Fi module 222, a Bluetooth (BT) module 223, a GNSS module 224 (e.g., a GPS module, a Glonass module, a Beidou module, or a Galileo module), an NFC module 225, MST module 226, and a radio frequency (RF) module 229.

The cellular module 221 may provide a voice call, image call, a text message service, or an Internet access service through, for example, a communication network. The cellular module 221 may distinguish between and authenticate electronic devices 201 within a communication network using a subscriber identification module (for example, the SIM 227). According to an embodiment of the present disclosure, the cellular module 221 may perform at least some of the functions that the processor 210 may provide. The cellular module 221 may include a communication processor (CP).

Each of the Wi-Fi module 222, the BT module 223, the GNSS module 224, the NFC module 225, and MST module 226 may include, for example, a processor for processing data transmitted and received through the relevant module. According to an embodiment of the present disclosure, at least some (e.g., two or more) of the cellular module 221, the Wi-Fi module 222, the BT module 223, the GNSS module 224, the NFC module 225, and MST module 226 may be included in one integrated chip (IC) or IC package.

The RF module 229 may transmit/receive, for example, a communication signal (for example, an RF signal). The RF module 229 may include, for example, a transceiver, a power amplifier module (PAM), a frequency filter, a low noise amplifier (LNA), and an antenna. According to an embodiment of the present disclosure, at least one of the cellular module 221, the Wi-Fi module 222, the BT module 223, the GNSS module 224, the NFC module 225, and MST module 226 may transmit and receive RF signals through a separate RF module.

The subscriber identification module 227 may include, for example, a card including a subscriber identity module and/or an embedded SIM, and may contain unique identification information (e.g., an integrated circuit card identifier (ICCID)) or subscriber information (e.g., an international mobile subscriber identity (IMSI)).

The memory 230 (for example, the memory 130) includes, for example, an internal memory 232 or an external memory 234. The embedded memory 232 may include at least one of a volatile memory (for example, a dynamic random access memory (DRAM), a static RAM (SRAM), a synchronous dynamic RAM (SDRAM), and the like) and a non-volatile memory (for example, a one time programmable read only memory (OTPROM), a programmable ROM (PROM), an erasable and programmable ROM (EPROM), an electrically erasable and programmable ROM (EEPROM), a mask ROM, a flash ROM, a flash memory (for example, a NAND flash memory or a NOR flash memory), a hard disc drive, a solid state drive (SSD), and the like).

The external memory 234 may further include a flash drive, for example, a compact flash (CF), a secure digital (SD), a micro secure digital (Micro-SD), a mini secure digital (Mini-SD), an extreme digital (xD), a memory stick, and the like. The external memory 234 may be functionally and/or physically connected to the electronic device 201 through various interfaces.

The sensor module 240 may measure a physical quantity or detect an operation state of the electronic device 201, and may convert the measured or detected information into an electrical signal. For example, the sensor module 240 includes at least one of a gesture sensor 240A, a gyro sensor 240B, an atmospheric pressure sensor 240C, a magnetic sensor 240D, an acceleration sensor 240E, a grip sensor 240F, a proximity sensor 240G, a color sensor 240H (for example, a red/green/blue (RGB) sensor), a bio-sensor 240I, a temperature/humidity sensor 240J, a light sensor 240K, and an ultra violet (UV) sensor 240M. Additionally or alternatively, the sensor module 240 may include, for example, an E-nose sensor, an electromyography (EMG)

sensor, an electroencephalogram (EEG) sensor, an electrocardiogram (ECG) sensor, an infrared (IR) sensor, an iris sensor, and/or a fingerprint sensor. The sensor module 240 may further include a control circuit for controlling one or more sensors included therein. In an embodiment of the present disclosure of the present disclosure, the electronic device 201 may further include a processor configured to control the sensor module 240 as a part of or separately from the processor 210, and may control the sensor module 240 while the processor 210 is in a sleep state.

The input device 250 includes, for example, a touch panel 252, a (digital) pen sensor 254, a key 256, or an ultrasonic input device 258. The touch panel 252 may use at least one of, for example, a capacitive type, a resistive type, an infrared type, and an ultrasonic type. Also, the touch panel 252 may further include a control circuit. The touch panel 252 may further include a tactile layer and provide a tactile reaction to the user.

The (digital) pen sensor 254 may include, for example, a recognition sheet which is a part of the touch panel or is separated from the touch panel. The key 256 may include, for example, a physical button, an optical key or a keypad. The ultrasonic input device 258 may detect ultrasonic wavers generated by an input tool through a microphone 288 and identify data corresponding to the detected ultrasonic waves.

The display 260 (for example, the display 160) may include a panel 262, a hologram device 264 or a projector 266. The panel 262 may include a configuration that is identical or similar to the display 160 illustrated in FIG. 1. The panel 262 may be implemented to be, for example, flexible, transparent, or wearable. The panel 262 and the touch panel 252 may be implemented as one module. The hologram 264 may show a three dimensional image in the air by using an interference of light. The projector 266 may display an image by projecting light onto a screen. The screen may be located, for example, inside or outside the electronic device 201. According to an embodiment of the present disclosure, the display 260 may further include a control circuit for controlling the panel 262, the hologram device 264, or the projector 266.

The interface 270 may include, for example, a high-definition multimedia interface (HDMI) 272, a universal serial bus (USB) 274, an optical interface 276, or a D-sub-miniature (D-sub) 278. The interface 270 may be included in, for example, the communication interface 170 illustrated in FIG. 1. Additionally or alternatively, the interface 270 may include, for example, a mobile high-definition link (MHL) interface, a secure digital (SD) card/multi-media card (MMC) interface, or an infrared data association (IrDA) standard interface.

The audio module 280 may bilaterally convert, for example, a sound and an electrical signal. At least some elements of the audio module 280 may be included in, for example, the input/output interface 145 illustrated in FIG. 1. The audio module 280 may process sound information which is input or output through, for example, a speaker 282, a receiver 284, earphones 286, the microphone 288 and the like.

The camera module 291 is a device which may photograph a still image and a dynamic image. According to an embodiment of the present disclosure, the camera module 291 may include one or more image sensors (for example, a front sensor or a back sensor), a lens, an image signal processor (ISP) or a flash (for example, LED or xenon lamp).

The power management module 295 may manage, for example, power of the electronic device 201. According to an embodiment of the present disclosure, the power management module 295 may include a power management integrated circuit (PMIC), a charger integrated circuit (IC), or a battery gauge. The PMIC may use a wired and/or wireless charging method. Examples of the wireless charging method may include, for example, a magnetic resonance method, a magnetic induction method, an electromagnetic method, and the like. Additional circuits (e.g., a coil loop, a resonance circuit, a rectifier, etc.) for wireless charging may be further included. The battery gauge may measure, for example, a residual charge quantity of the battery 296, and a voltage, a current, or a temperature during the charging. The battery 296 may include, for example, a rechargeable battery or a solar battery.

The indicator 297 may display a particular state (e.g., a booting state, a message state, a charging state, and the like) of the electronic device 201 or a part (e.g., the processor 210). The motor 298 may convert an electrical signal into mechanical vibration, and may generate vibration, a haptic effect, and the like. The electronic device 201 may include a processing unit (e.g., a GPU) for supporting a mobile television (TV). The processing unit for supporting mobile TV may, for example, process media data according to a certain standard such as digital multimedia broadcasting (DMB), digital video broadcasting (DVB), or mediaFLO™.

Each of the above-described component elements of hardware according to an embodiment of the present disclosure may be configured with one or more components, and the names of the corresponding component elements may vary based on the type of electronic device. The electronic device may include at least one of the aforementioned elements. Some elements may be omitted or other additional elements may be further included in the electronic device. Also, some of the hardware components may be combined into one entity, which may perform functions identical to those of the relevant components before the combination.

Figure 3:
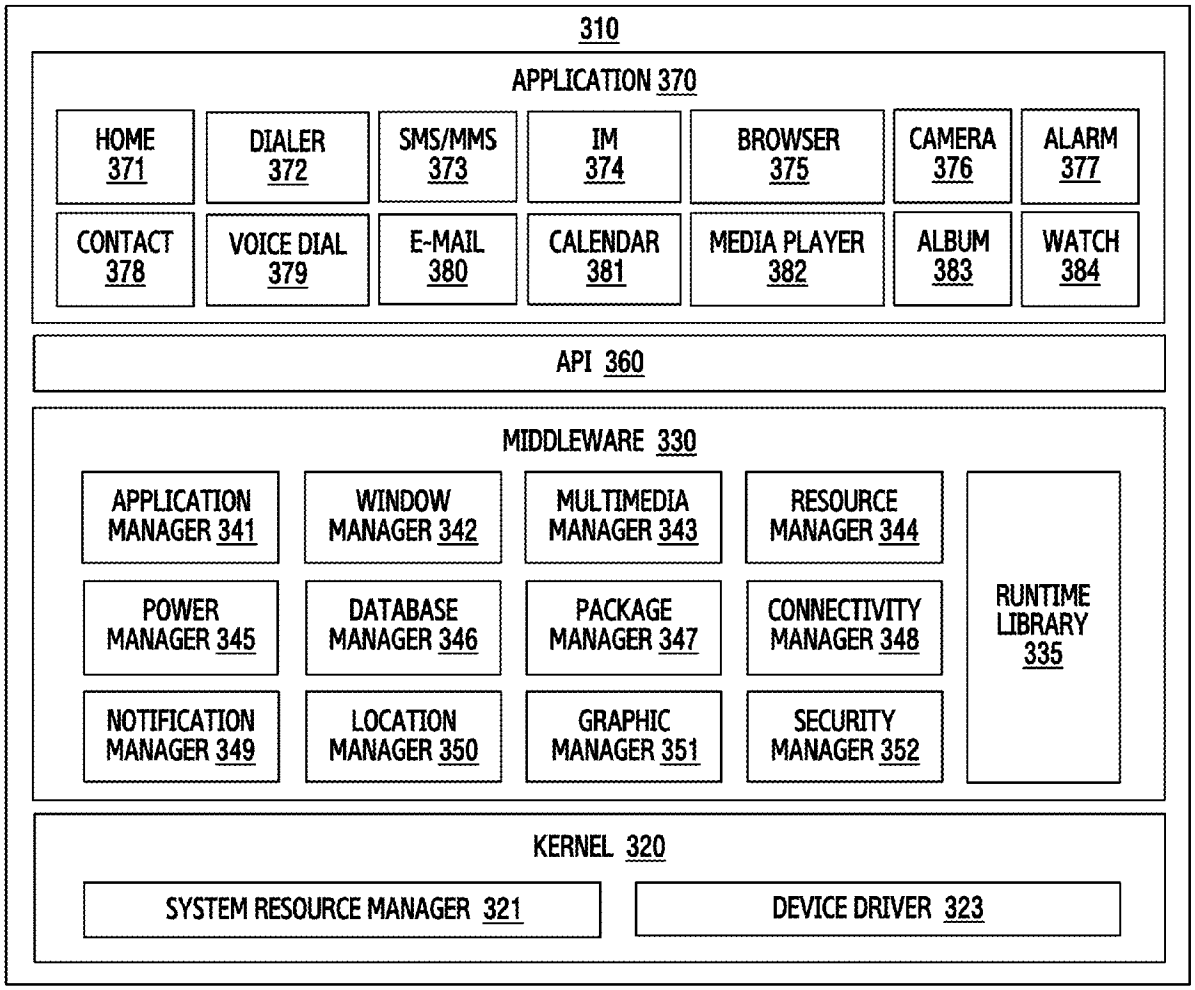
FIG. 3 is a block diagram of a program module according to an embodiment of the present disclosure.

FIG. 3 is a block diagram of a program module according to an embodiment of the present disclosure.

The program module 310 (for example, the program 140) may include an operating system (OS) for controlling resources related to the electronic device (for example, the electronic device 101) and/or various applications (for example, the application programs 147) executed in the operating system. The operating system may be, for example, Android, iOS, Windows, Symbian, Tizen, Bada, and the like.

The program module 310 includes a kernel 320, middleware 330, an API 360, and/or an application 370. At least some of the program module 310 may be preloaded on the electronic device, or may be downloaded from the electronic device 102 or 104, or the server 106.

The kernel 320 (e.g., the kernel 141) includes, for example, a system resource manager 321 and/or a device driver 323. The system resource manager 321 may perform the control, allocation, retrieval, and the like of system resources. According to an embodiment of the present disclosure, the system resource manager 321 may include a process manager, a memory manager, a file system manager, and the like. The device driver 323 may include, for example, a display driver, a camera driver, a Bluetooth driver, a shared memory driver, a USB driver, a keypad driver, a Wi-Fi driver, an audio driver, or an inter-process communication (IPC) driver.

The middleware 330 may provide a function required by the applications 370 in common or provide various functions to the applications 370 through the API 360 so that the applications 370 may efficiently use limited system resources within the electronic device. According to an embodiment of the present disclosure, the middleware 330 (for example, the middleware 143) includes, for example, at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, and a security manager 352.

The runtime library 335 may include a library module that a compiler uses in order to add a new function through a programming language while the applications 370 are being executed. The runtime library 335 may perform input/output management, memory management, the functionality for an arithmetic function, and the like.

The application manager 341 may manage, for example, the life cycle of at least one of the applications 370. The window manager 342 may manage graphical user interface (GUI) resources used for the screen. The multimedia manager 343 may determine a format required to reproduce various media files, and may encode or decode a media file by using a coder/decoder (codec) appropriate for the relevant format. The resource manager 344 may manage resources, such as a source code, a memory, a storage space, and the like of at least one of the applications 370.

The power manager 345 may operate together with a basic input/output system (BIOS) to manage a battery or power and may provide power information required for the operation of the electronic device. The database manager 346 may generate, search for, and/or change a database to be used by at least one of the applications 370. The package manager 347 may manage the installation or update of an application distributed in the form of a package file.

The connectivity manager 348 may manage a wireless connection such as, for example, Wi-Fi or Bluetooth. The notification manager 349 may display or notify of an event, such as an arrival message, an appointment, a proximity notification, and the like, in such a manner as not to disturb the user. The location manager 350 may manage location information of the electronic device. The graphic manager 351 may manage a graphic effect, which is to be provided to the user, or a user interface related to the graphic effect. The security manager 352 may provide various security functions required for system security, user authentication, and the like. According to an embodiment of the present disclosure, when the electronic device (e.g., the electronic device 101) has a telephone call function, the middleware 330 may further include a telephony manager for managing a voice call function or a video call function of the electronic device.

The middleware 330 may include a middleware module that forms a combination of various functions of the above-described elements. The middleware 330 may provide a module specialized for each type of OS in order to provide a differentiated function. Also, the middleware 330 may dynamically delete some of the existing elements, or may add new elements.

The API 360 (e.g., the API 145) is, for example, a set of API programming functions, and may be provided with a different configuration according to an OS. For example, in the case of Android or iOS, one API set may be provided for each platform. In the case of Tizen, two or more API sets may be provided for each platform.

The applications 370 (for example, the application program 147) includes, for example, one or more applications which may provide functions such as home 371, dialer 372, SMS/MMS 373, instant message (IM) 374, browser 375, camera 376, alarm 377, contacts 378, voice dialer 379, email 380, calendar 381, media player 382, album 383, clock 384, health care (for example, measure exercise quantity or blood sugar level), or environmental information (for example, atmospheric pressure, humidity, or temperature information).

According to an embodiment of the present disclosure, the applications 370 may include an information exchange application supporting information exchange between the electronic device 101 and the electronic device 102 or 104. The application associated with information exchange may include, for example, a notification relay application for forwarding specific information to an external electronic device, or a device management application for managing an external electronic device.

For example, the notification relay application may include a function of delivering, to the electronic device 102 or 104, notification information generated by other applications (e.g., an SMS/MMS application, an email application, a health care application, an environmental information application, etc.) of the electronic device 101. Further, the notification relay application may receive notification information from, for example, an external electronic device and provide the received notification information to a user.

The device management application may manage (for example, install, delete, or update), for example, a function for at least a part of the external electronic device 102 or 104 communicating with the electronic device (for example, turning on/off the external electronic device itself (or some elements thereof) or adjusting brightness (or resolution) of a display), applications executed in the external electronic device, or services provided from the external electronic device (for example, a telephone call service or a message service).

According to an embodiment of the present disclosure, the applications 370 may include applications (for example, a health care application of a mobile medical appliance and the like) designated according to attributes of the external electronic device 102 or 104. The application 370 may include an application received from the server 106, or the electronic device 102 or 104. The application 370 may include a preloaded application or a third party application which may be downloaded from the server. Names of the elements of the program module 310, may change depending on the type of OS.

According to an embodiment of the present disclosure, at least some of the program module 310 may be implemented in software, firmware, hardware, or a combination of two or more thereof. At least some of the program module 310 may be implemented (e.g., executed) by, for example, the processor (e.g., the processor 210). At least some of the program module 310 may include, for example, a module, a program, a routine, a set of instructions, and/or a process for performing one or more functions.

The term "module" as used herein may, for example, mean a unit including one of hardware, software, and firmware or a combination of two or more of them. The term "module" may be interchangeably used with, for example, the term "unit", "logic", "logical block", "component", or "circuit". The "module" may be a minimum unit of an integrated component element or a part thereof. The "module" may be a minimum unit for performing one or more functions or a part thereof. The "module" may be mechanically or electronically implemented. For example, the "module" according to the present disclosure may include at least one of an application-specific integrated circuit (ASIC) chip, a field-programmable gate arrays (FPGA), and a programmable-logic device for performing operations which has been known or are to be developed hereinafter.

The module or the program module, may include one or more elements described above, exclude some of them, or further include other elements. The operations performed by the module, the program module, or other elements, may be executed in a sequential, parallel, iterative, or heuristic method. In addition, some operations may be executed in a different order, or may be omitted, or other operations may be added. In addition, the embodiments disclosed in the present specification are intended for the explanation and understanding of the technical matter, and shall not limit the scope of the technology described in the present document. Accordingly, the scope of the present disclosure should be construed to encompass all modifications or various other embodiments based on the technical concept of the present disclosure.

Figure 4:
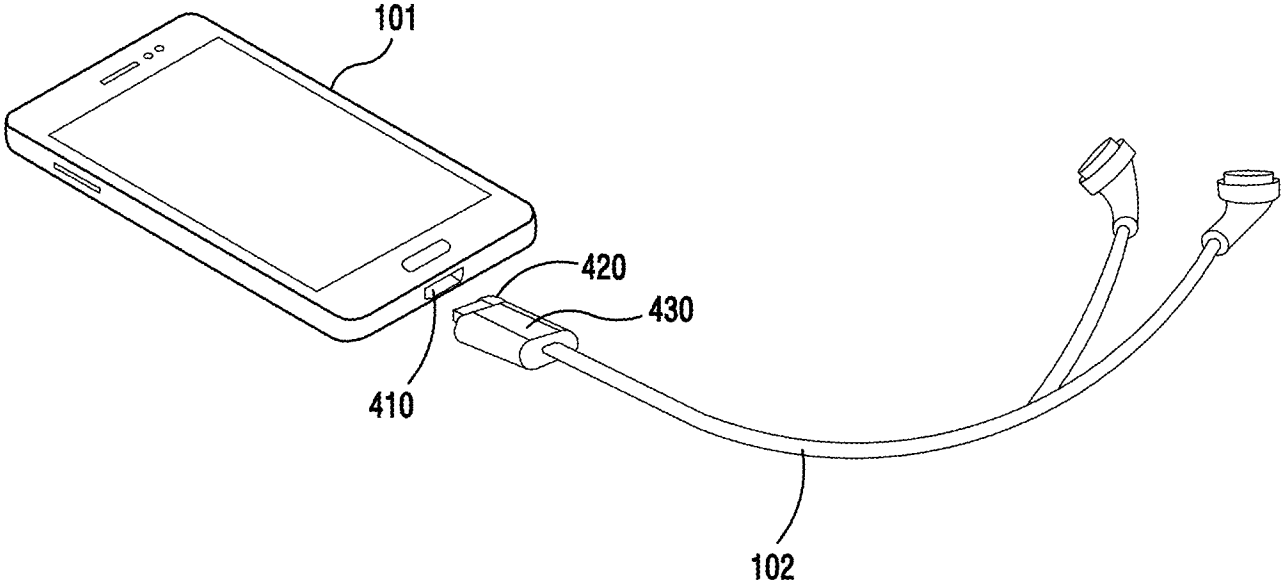
FIG. 4 is a diagram of audio signal controlling according to an embodiment of the present disclosure.

FIG. 4 is a diagram of audio signal controlling according to an embodiment of the present disclosure.

Referring to FIG. 4, an electronic device 101 includes a receptacle 410 which supports universal serial bus (USB) Type-C standard. The electronic device 101 may transmit and receive various signals through the receptacle 410. For example, using the receptacle 410, the electronic device 101 may transmit and receive at least one of an analog audio signal, a digital signal including a digital audio signal, and a power signal.

According to an embodiment of the present disclosure, the receptacle 410 may be disposed inside a hole connected to an opening formed in a housing side of the electronic device 101. The receptacle 410 may receive an external connector 430. The receptacle 410 may include a plurality of pins according to the USB 3.1 Type-C standard. The pins of the receptacle 410 and the signal input/output through the receptacle 410 shall be described in detail by referring to FIGS. 5, 6, and 7.

According to an embodiment of the present disclosure, the electronic device 101 may identify a type of an external device 102 connected through the receptacle 410. The electronic device 101 may include components for controlling signal transmission and reception with the identified external device 102, which shall be described in FIG. 8 through FIG. 25.

According to an embodiment of the present disclosure, the external device 102 may include an external connector 430 (or a plug 420) which may be inserted into the receptacle 410. The external device 102 includes, but is not limited to, an earphone in FIG. 1. For example, the external device 102 may include any device for inputting and outputting an analog audio signal or a digital audio signal, such as a headset, a speaker, and a USB memory. The external device 102 may include a charging device for supplying power to the electronic device 101.

According to an embodiment of the present disclosure, the external connector 430 may be configured.

According to an embodiment of the present disclosure, the external device 102 may include a device for inputting and outputting an unbalanced audio signal. For example, the external device 102 may include, but is not limited to, a device including a USB 2.0 Type-C interface. The external device 102 may include, but is not limited to, a device for inputting and outputting a balanced audio signal. The external device 102 may include, but is not limited to, a device for inputting and outputting an unbalanced audio signal and power. The external device 102 may include, but is not limited to, a device for inputting and outputting both of an analog signal and a digital signal.

According to an embodiment of the present disclosure, the external connector 430 may include a plurality of pins which may be inserted into the receptacle 410. The pins of the external connector 430 and the signal input/output through the receptacle 410 shall be described in detail by referring to FIGS. 6 and 7.

According to an embodiment of the present disclosure, when the electronic device 101 and the external device 102 are connected through the receptacle 410 and the external connector 430, they may serve as a host (e.g., a downstream facing port (DFP)) and a device (or a slave such as an upstream facing port (UFP)) respectively.

According to an embodiment of the present disclosure, besides the host (DFP) and the device (UFP), the electronic device 101 and the external device 102 may serve as dual role ports (DRPs). The DRP may indicate a mode (function) for adaptively switching the role of the host (DFP) or the device (UFP) of the electronic device 101. For example, when the DRP is connected as the host (DFP), the electronic device 101 may be switched to the device (UFP). When the DRP is connected as the device (UFP), the electronic device 101 may be switched to the host (DFP). For example, when two DRP are connected together, one of the host (DFP) and the device (UFP) may serve as the host (DFP) and the other may serve as the device (UFP). For example, the electronic device 101 such as a smart phone or a PC may serve as either the host (DFP) or the device (UFP). For doing so, the electronic device 101 may periodically toggle pull-up and pull-down.

Figure 5A:
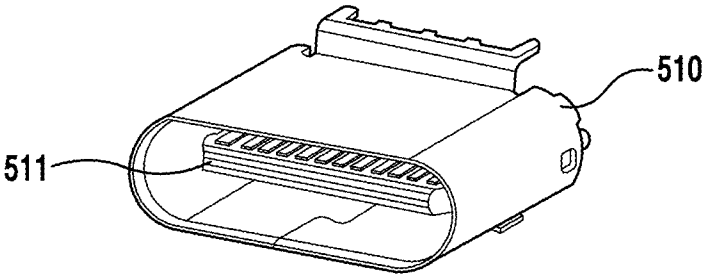
FIGS. 5A and 5B are diagrams of a receptacle according to an embodiment of the present disclosure.
Figure 5B:
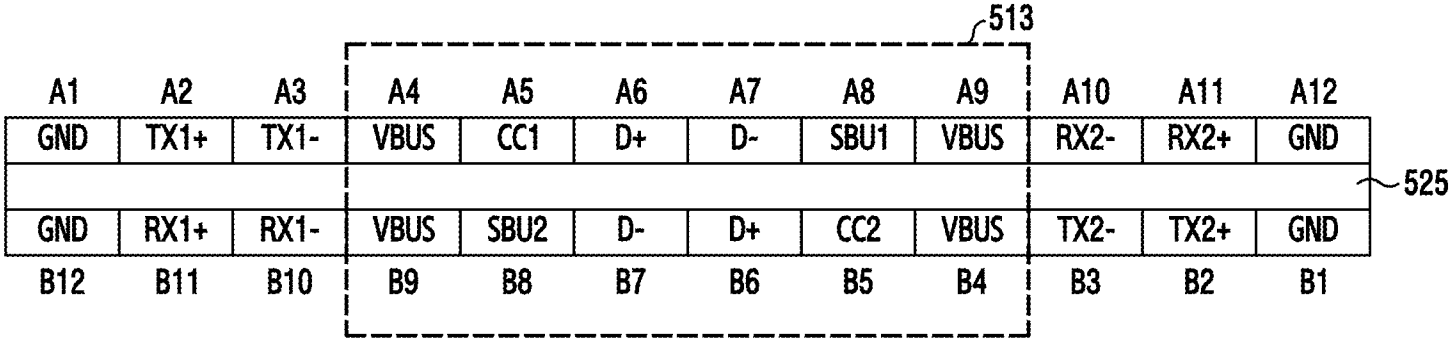

FIGS. 5A and 5B depict a receptacle according to an embodiment of the present disclosure.

FIGS. 5A and 5B show a function pin structure of a receptacle 510 based on the USB Type-C standard according to an embodiment of the present disclosure. Hereafter, to clarify the understanding, the term 'pin' is used together with the term 'port'.

FIG. 5A shows the receptacle 510 including a plurality of pins 511. The receptacle 510 may be implemented using a female connector or a male connector.

FIG. 5B shows a pin map of the pins 511 of the receptacle 510.

According to an embodiment of the present disclosure, the pins 511 may include A pins A1 through A12 and B pins B1 through B12. The A pins and the B pins may be disposed symmetrically. For example, ground pins A1, A12, B1, and B12, pins A2, A3, A10, A11, B2, B3, B10, and B11 supporting high speed transmission of digital data, pins A4, A9, B4, and B9 supporting power supply, channel configuration (CC) pins A5 and B5, sideband use (SBU) pins A8 and B8, and pins A6, A7, B6, and B7 supporting low-speed data transmission may be disposed symmetrically. Hence, the receptacle 510 may transmit and receive signals regardless of the orientation of an external connector (or a plug of the external connector plug) inserted.

According to an embodiment of the present disclosure, when the receptacle 510 is connected with an external connector (or an external device) supporting only USB 2.0 Type-C standard, it may transmit and receive signals using the pins 513 (A4 through A9 and B4 through B9) in a dotted line.

According to an embodiment of the present disclosure, a tongue 511 of the receptacle 510 may include a base plate and a mid-plate. The mid-plate may be electrically connected to a circuit board and used as a ground return path.

According to an embodiment of the present disclosure, the electronic device 101 may configure (or define) data signal (D+, D−) pins A6, A7, B6, and B7 according to its operation mode or a type of the external device with which the analog audio signal is exchanged. For example, the electronic device 101 may configure, but is not limited to, the pins A6, A7, B6, and B7 to transmit and receive balanced audio signals. For example, the electronic device 101 may configure, but is not limited to, the pins A6, A7, B6, and B7 to transmit and receive dual channel stereo audio signals or 4-channel audio signals. The pin configuration according to the operation mode of the electronic device 101 or the external device type shall be further described by referring to FIG. 8.

According to an embodiment of the present disclosure, the electronic device 101 may configure the pins A8 and B8 to transmit and receive voice signals obtained from a microphone of the electronic device 101 or the external device. For example, the electronic device 101 may configure one of the SBU pins A8 and B8 as the pin for transmitting and receiving voice signals obtained from the microphone, and the other as an analog ground (AGND) pin.

Figure 6A:
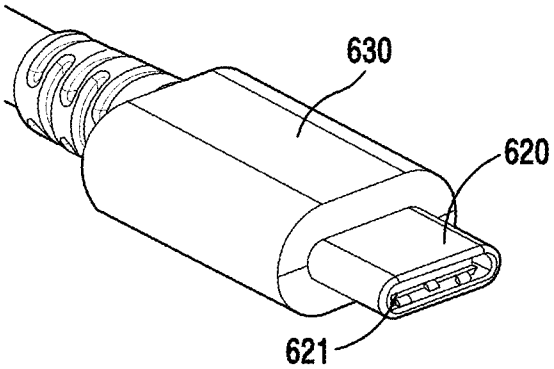
FIGS. 6A and 6B are diagrams of an external connector according to an embodiment of the present disclosure.
Figure 6B:
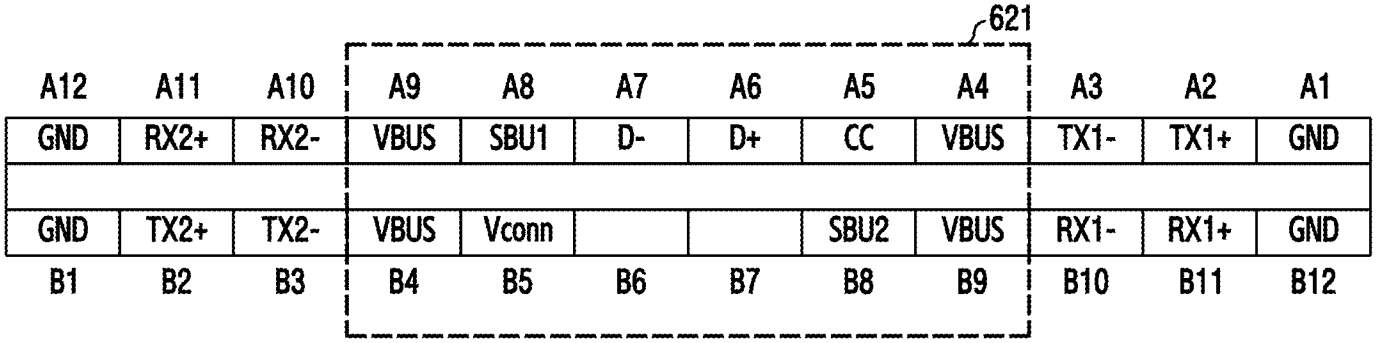

FIGS. 6A and 6B depict an external connector according to an embodiment of the present disclosure.

FIGS. 6A and 6B show a function pin structure of an external connector 630 of the USB Type-C standard.

FIG. 6A shows the external connector 630 including a plug 620. According to an embodiment of the present disclosure, the plug 620 may be implemented using a male connector or a female connector.

FIG. 6B shows a pin map of pins 621 of the plug 620.

According to an embodiment of the present disclosure, the pins 621 may include A pins A1 through A12 and B pins B1 through B12. The A pins and the B pins may be disposed symmetrically. For example, ground pins A1, A12, B1, and B12, pins A2, A3, A10, A11, B2, B3, B10, and B11 supporting high speed transmission of digital data, pins A4, A9, B4, and B9 supporting power supply, a CC pin A5 and a Vconn pin B5, SBU pins A8 and A8, and pins A6, A7, B6, and B7 supporting low-speed data transmission may be disposed symmetrically. As the A pins and the B pins are disposed symmetrically, when the plug 620 is inserted into a receptacle, signals may be transmitted and received to and from the receptacle regardless of an insertion orientation of the plug 620. For example, when an external device connected to the plug 620 supports only the USB 2.0 Type-C standard, analog audio signals or digital signals may be transceived by, but is not limited to, shorting the B pins B6 and B7 of which signals are not defined in the standard, to the A pins A7 and A6. For example, when the plug 620 is inserted into the receptacle, the electronic device 101 may detect the insertion orientation of the plug 620 and transceive signals using the A pins or the B pins according to the detected insertion orientation. For example, when the external device connected to the plug 620 supports only the USB 2.0 Type-C standard, the electronic device 101 may detect the insertion orientation of the plug 620 of the external device by detecting a voltage (or resistance) level received through one of the pins (e.g., A5, B5). The electronic device 101 may transceive signals using either the A pins or the B pins configured to transceive signals according to the insertion orientation.

According to an embodiment of the present disclosure, when the plug 620 is connected to a device supporting only the USB 2.0 Type-C standard, the plug 620 may transceive signals using pins 621 (A4 through A9, B4 through B9) shown in FIG. 6B within the dotted line.

According to an embodiment of the present disclosure, when an external device including the plug 620 is a balanced analog audio device, the plug 620 may transceive signals through the pins B6 and B7 of which signals are not defined in the recent USB 3.1 Type-C standard. For example, the plug 620 may receive a balanced stereo audio signal from the electronic device 101 through, but is not limited to, the pins B6 and B7 and the pins A6 and A7.

Figure 7:
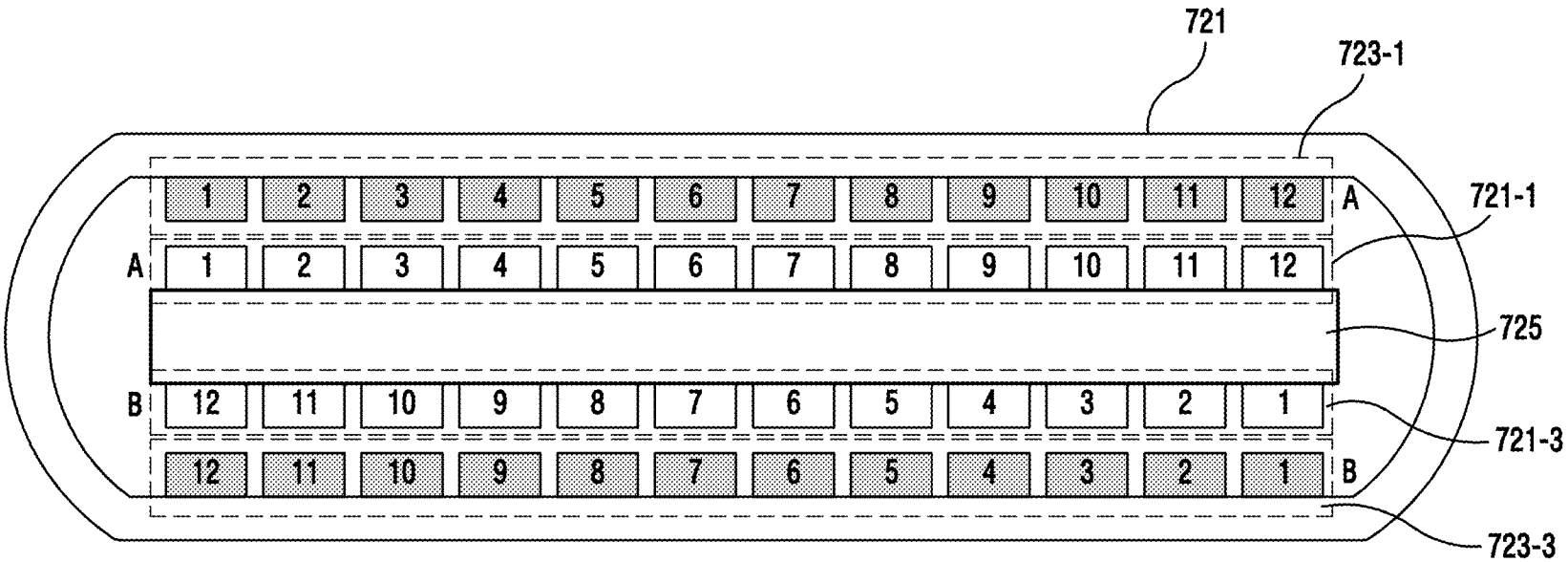
FIG. 7 is a diagram of an external connector inserted into a receptacle according to an embodiment of the present disclosure.

FIG. 7 depicts an external connector inserted into a receptacle according to an embodiment of the present disclosure.

A plurality of pins 723-1 and 723-3 of the external connector (or a plug) may be inserted between pins of the receptacle 721 and a tongue 725 of the receptacle 721.

The external connector may be inserted into the receptacle 721 regardless of (or reversibly) an orientation of the external connector. For example, A pins 721-1 of the receptacle 721 may connect to (or contact) the A pins 723-1 of the external connector, and B pins 721-3 of the receptacle 721 may connect to (or contact) with the B pins 723-3 of the external connector (or in an unflipped state). For example, the A pins 721-1 of the receptacle 721 may connect to with the B pins 723-3 of the external connector, and the B pins 721-3 of the receptacle 721 may connect to with the A pins 723-1 of the external connector (or in a flipped state).

The A pins 721-1 of the receptacle 721 may be disposed on a front side, for example, a surface where a display is exposed to the outside, in the electronic device 101. According to an embodiment of the present disclosure, the receptacle 721 may include the A pins 721-1 in a rear side of the electronic device 101, in an opposite side of the exposed display, or on a side where a battery is disposed.

A processor 120 may provide an audio signal to the external connector through the receptacle 721.

Figure 8:
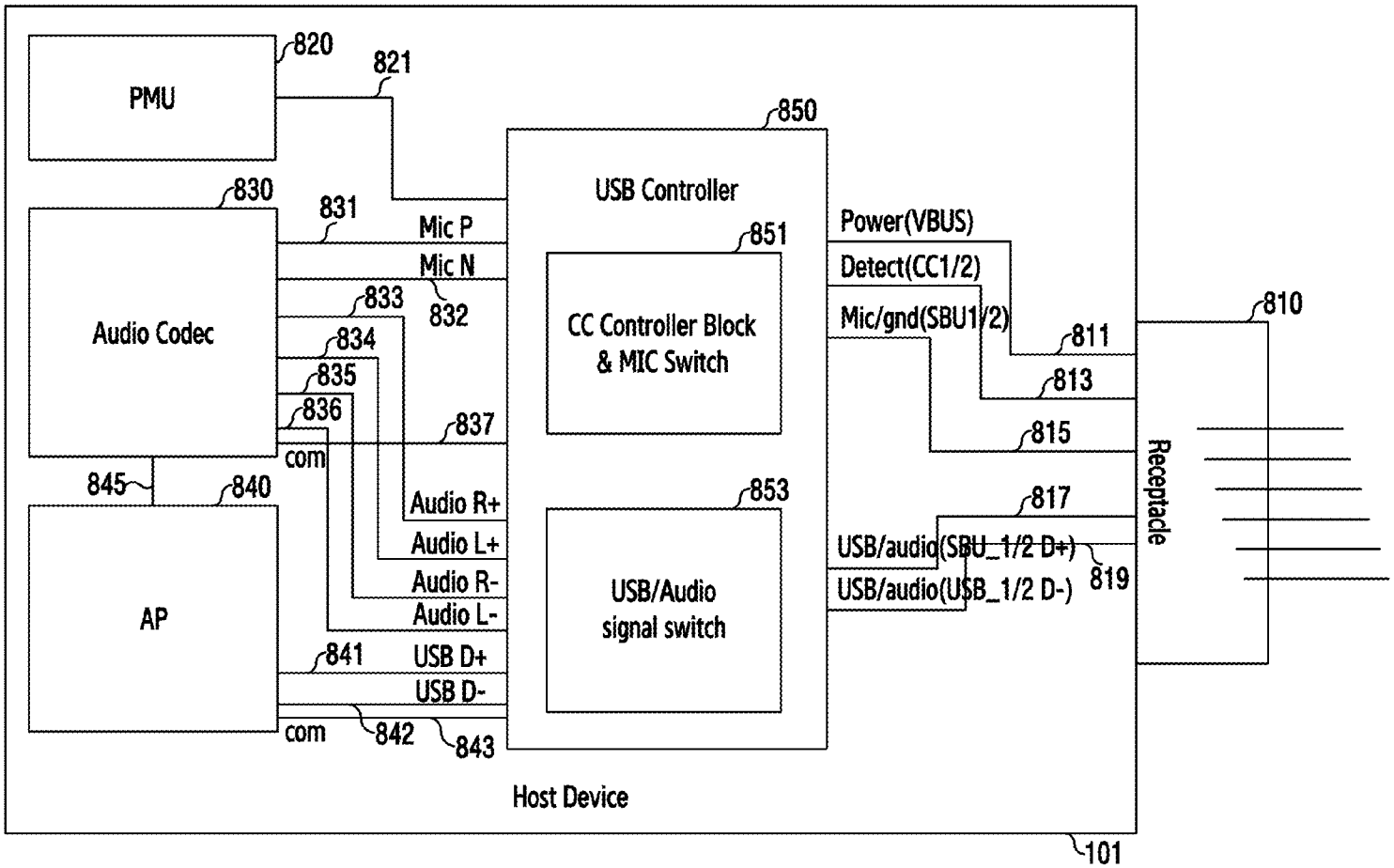
FIG. 8 is a block diagram of an electronic device according to an embodiment of the present disclosure of the present disclosure.

FIG. 8 is a block diagram of an electronic device according to an embodiment of the present disclosure.

Referring to FIG. 8, the electronic device (host device) 101 includes a receptacle 810, a power management unit (PMU) 820, an audio codec 830, an application processor (AP) 840, and a USB controller 850.

The PMU 820 may control power of the electronic device 101. For example, the PMU 820 may control the power to minimize power consumption of operations in the AP 840. For example, the PMU 820 may control charging based on a charging state of a battery. For example, the PMU 820 may control power transmission and reception to and from an external device connected to the receptacle 810 through a Vbus port (or pin) or a CC port. The PMU 820 may send a control signal to the USB controller 850 through the receptacle 821.

The audio codec 830 may encode or decode data including analog audio data and digital audio data. The audio codec 830 may output an analog unbalanced audio signal and an analog balanced audio signal. When outputting the analog balanced audio signal, the audio codec 830 may send the analog balanced audio signals Audio R+, Audio R−, Audio L+, and Audio L− to the USB controller 850 through paths 833 through 836 respectively. The Audio R+ signal and the Audio L+ signal may be analog audio signals of an in-phase waveform. The Audio R− signal and the Audio L− signal may be analog audio signals of an out-of-phase waveform. The analog balanced audio signals Audio R+, Audio R−, Audio L+, and Audio L− are shown in FIG. 8, but the present disclosure is not limited to those signals. For example, the audio codec 830 may output the analog unbalanced audio signals Audio R and Audio L of one-phase waveform.

The audio codec 830 may transceive voice signals obtained from a microphone of the electronic device 101 or an external device, with the USB controller 850 through the paths 831 and 832. According to an embodiment of the present disclosure, the audio codec 830 may transceive control signals for controlling the voice signal transmission and reception, with the USB controller 850 through a path 837.

The AP 840 may control the operations of the electronic device 101. The AP 840 may correspond to the processor 120 of FIG. 1. The AP 840 may transceive digital data signals through paths 841 and 842. For example, the AP 840 may send USB data signals USB D+ and USB D− to the USB controller 850 through the paths 841 and 842. For example, the AP 840 may send a signal (com) for controlling the USB controller 850 through the path 843. For example, when identifying a type of the external device connected through the receptacle 810, the AP 840 may send to the USB controller 850 a control signal for controlling switching of a USB/audio signal switch 853 so as to send a signal adequate for the identified external device (or the external device type).

The USB controller 850 may include a CC controller block/MIC switch 851 and the USB/audio signal switch 853.

The CC controller block/MIC switch 851 may detect the connection of the external device, an operation mode of the electronic device 101, a connection orientation of the connected external device, or the type of the connected external device, at least based on signals received through pins of the receptacle 810.

For example, the CC controller block/MIC switch 851 may obtain information contained in a CC signal received from a CC port of the receptacle 810 through the path 813, for example, information about an impedance of a pull-down resistor (a voltage measured at the pull-down resistor Rd), a voltage Vopen measured in an open state, or a resistance Ra of a cable (or a voltage measured by the resistance Ra). At least based on such information, the CC controller block/MIC switch 851 may detect the connection of the external device, the operation mode of the electronic device 101, the connection orientation of the connected external device, or the type of the connected external device.

According to an embodiment of the present disclosure, the CC controller block/MIC switch 851 may detect the type of the external device connected to the electronic device 101 at least based on an SBU signal received from an SBU port through the path 813. For example, the CC controller block/MIC switch 851 may detect the type of external device connected to the electronic device 101 by obtaining an audio accessory IDentifier (ID) (or an audio accessory ID impedance value) of the SBU signal.

According to an embodiment of the present disclosure, when the CC controller block/MIC switch 851 includes a communication integrated circuit (IC), the communication IC may communicate with the external device through the SBU port and thus detect the type of external device connected to the electronic device 101. For example, the communication IC may transceive signals including at least one of an audio output method, a type, a vendor, and a unique number of the external device through the SBU port. For example, the communication IC may, but is not limited to, authenticate the vendor by communicating with the external device through the SBU port.

According to an embodiment of the present disclosure, the CC controller block/MIC switch 851 may configure the SBU port or change the configuration of the SBU port in order to transceive voice signals obtained from the microphone of the electronic device 101 or the external device. For example, the CC controller block/MIC switch 851 may configure the SBU port, for example, a first SBU port (or a second SBU port) as a port for transceiving the voice signals obtained from the microphone, and configure the second SBU port (or the first SBU port) as an analog ground (AGND) port. For example, the CC controller block/MIC switch 851 may change the configuration to switch the SBU for transceiving the voice signals obtained from the microphone, to the AGND port, and to switch the SBU port serving as the AGND port to the port for transceiving the voice signals obtained from the microphone.

Based on a signal received through the VBUS port, The CC controller block/MIC switch 851 may determine whether the external device is connected. For example, the CC controller block/MIC switch 851 may determine whether the external device is connected or disconnected, based on a voltage value received from the VBUS port along the port 811.

Under control of the AP 840, the USB/audio signal switch 853 may output the analog audio signal received from the audio codec 830 or the digital signal received from the AP 840, to the external device via the receptacle 810 through the switching. For example, the USB/audio signal switch 853 may receive the analog audio signal from the audio codec 830 along the paths 833 through 836 and send them to the receptacle 810 along the paths 817 and 819. For example, the USB/audio signal switch 853 may receive the digital signal from the AP 840 along the paths 841 and 842 and send them to the receptacle 810 along the paths 817 and 819. The structure and the operations of the USB/audio signal switch 853 shall be explained in more detail by referring to FIGS. 18, 19 and 20.

Figure 9:
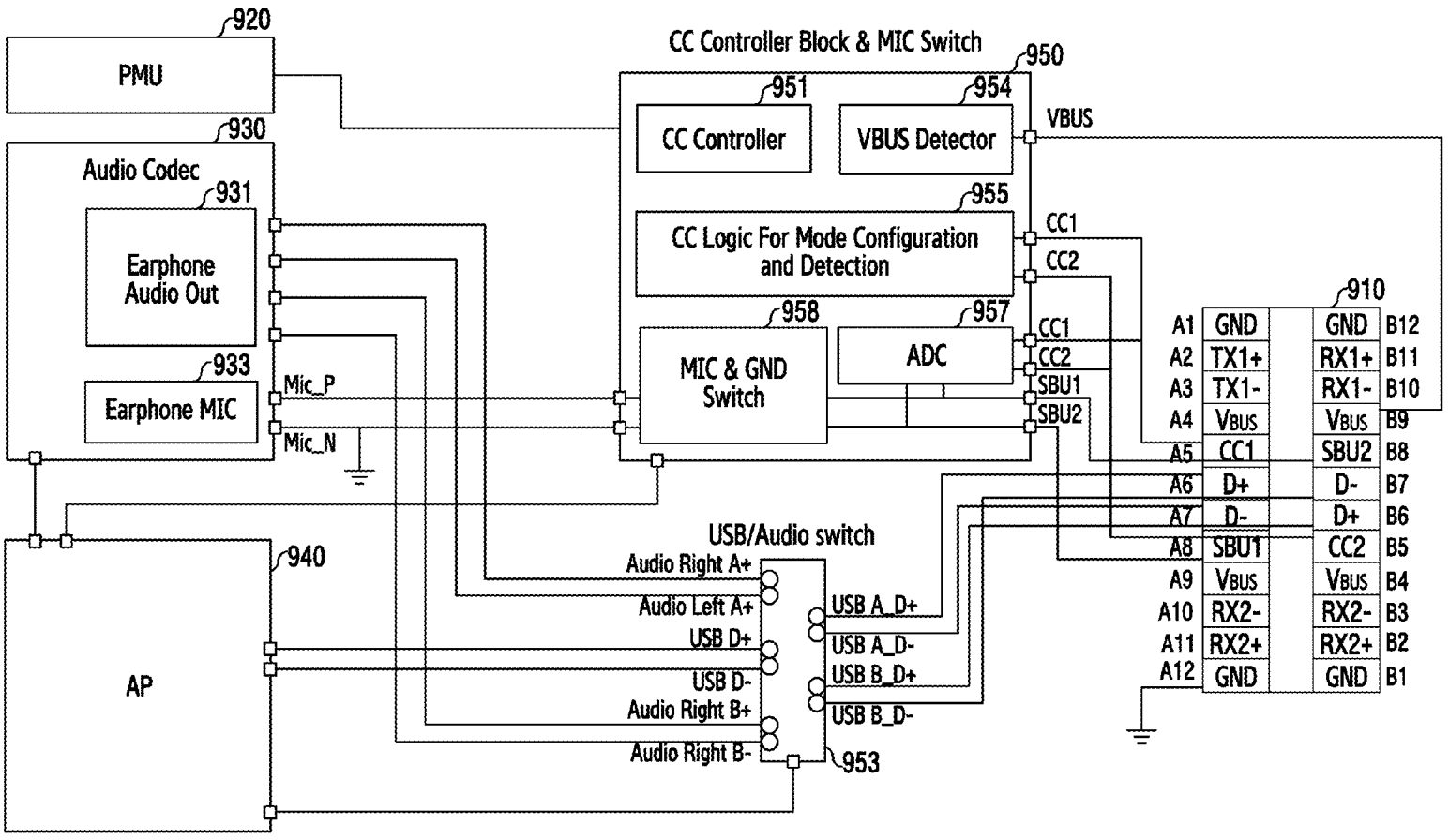
FIG. 9 is a block diagram of an electronic device according to an embodiment of the present disclosure of the present disclosure.

FIG. 9 is a block diagram of an electronic device according to an embodiment of the present disclosure of the present disclosure.

Components of an electronic device 901 of FIG. 9 may include detailed configurations of the components of the electronic device 101 of FIG. 8. The structure of the electronic device 901 of FIG. 9 may be the same as or similar to at least part of the structure of the electronic device 101 of FIG. 8, which shall be omitted.

The electronic device (host device) 901 includes a receptacle 910, a PMU 920, an audio codec 930, an AP 940, a CC controller block/MIC switch 950, and a USB/audio signal switch 953. The CC controller block/MIC switch 950 may correspond to the same or similar structure as the CC controller block/MIC switch 951 of FIG. 8.

The audio codec 930 may include an earphone audio out 931 and an earphone microphone 933. The earphone audio out 931 may output an analog audio signal to the USB/audio switch 953. For example, according to settings of the electronic device 901 or a type of an external device connected to the electronic device 901, the earphone audio out 931 may output an analog unbalanced audio signal, an analog balanced audio signal, a dual channel unbalanced audio signal, or a 4-channel audio signal to the USB/audio switch 953. The earphone microphone 933 may output a voice signal obtained through a microphone, to the CC controller block/MIC switch 950. The CC controller block/MIC switch 950 may send the voice signal output from the earphone microphone 933 to a first SBU port A8 or a second SBU port B8 of the receptacle 910.

The CC controller block/MIC switch 950 includes a CC controller 951, a VBUS detector 954, a CC logic 955, an analog to digital converter (ADC) 957, and a microphone/GND switch 958.

The CC controller 951 may control operations of the CC controller block/MIC switch 950. For example, based on a signal received from at least one of the VBUS detector 954, the CC logic 955, the microphone/GND switch 958, and the ADC 957, the CC controller 951 may detect a connection of an external device, an operation mode of the electronic device 901, a connection orientation of the connected external device, or a type of the connected external device.

For example, at least based on information contained in a CC signal received from a CC port of the receptacle 910, for example, information about an impedance of a pull-down resistor (a voltage measured at the pull-down resistor Rd), a voltage Vopen measured in an open state, or a resistance Ra of a cable (or a voltage measured by the resistance Ra), the CC controller 951 detects the connection of the external device, the operation mode of the electronic device 901, the connection orientation of the connected external device, or the type of connected external device.

The VBUS detector 954 may detect a signal received through a VBUS port. For example, the VBUS detector 954 may detect a voltage received through the VBUS port of the receptacle 910. The CC controller 951 may determine whether the external device is connected or disconnected, based on the voltage value received through the VBUS port.

The CC logic 955 may detect the operation mode of the electronic device 901 at least based on a signal received through a CC port of the receptacle 910. For example, at least based on CC signals received through CC ports CC1 and CC2, the CC logic 955 may determine whether the electronic device 901 is in an audio adaptor accessory mode (or whether the external device connected to the electronic device 901 is an analog audio device).

According to an embodiment of the present disclosure, the CC logic 955 may detect the connection orientation or cable twist of the external connector. The CC logic 955 may detect power supply (or power supply flow) between the electronic device 901 and the external device. The CC logic 955 may control the configuration for operating the electronic device 901 as the host (e.g., a DFP), the device (or slave (e.g., a UFP), or as the DRP.

The microphone/GND switch 958 may perform the switching to selectively send the signal of the first SBU port A8 or the second SBU port B8 of the receptacle 910, so as to send the microphone voice signal fed from the receptacle 910 to the earphone microphone 933. For example, when the first SBU port A8 is configured to transceive the microphone signals and the second SBU port B8 serves as the AGND, the microphone/GND switch 958 may switch to send the microphone voice signal received via the first SBU port A8 of the receptacle 910 to the earphone microphone 933. For example, when the second SBU port B8 is configured to transceive the microphone signals and the first SBU port A8 serves as the AGND, the microphone/GND switch 958 may switch to send the microphone voice signal received through the second SBU port B8 of the receptacle 910 to the earphone microphone 933.

In FIG. 9, the microphone/GND switch 958 is included in, but is not limited to, the CC controller block/MIC switch 950. For example, the microphone/GND switch 958 may be included in the electronic device 901 separately from the CC controller block/MIC switch 950.

The ADC 957 may detect (or measure) the signals received from the CC ports CC1 and CC2 or the SBU ports SBU1 and SBU2 of the receptacle 910, for example, a voltage value (or an impedance value of a resistance).

The ADC 957 may detect the information contained in the CC signal received from the CC port of the receptacle 910, for example, the information about an impedance of a pull-down resistor (a voltage measured at the pull-down resistor Rd), a voltage Vopen measured in an open state, or a resistance Ra of a cable (or a voltage measured by the resistance Ra). For example, the CC controller 951 may obtain an audio accessory ID (or an audio accessory ID impedance value) from the CC signal through the ADC 957 or the CC logic 955 and thus detect the type of external device connected to the electronic device 901.

According to an embodiment of the present disclosure, the CC controller 951 may obtain the audio accessory ID (or the audio accessory ID impedance value) from the SBU signal through the ADC 957 and thus detect the type of the external device connected to the electronic device 901.

Figure 10:
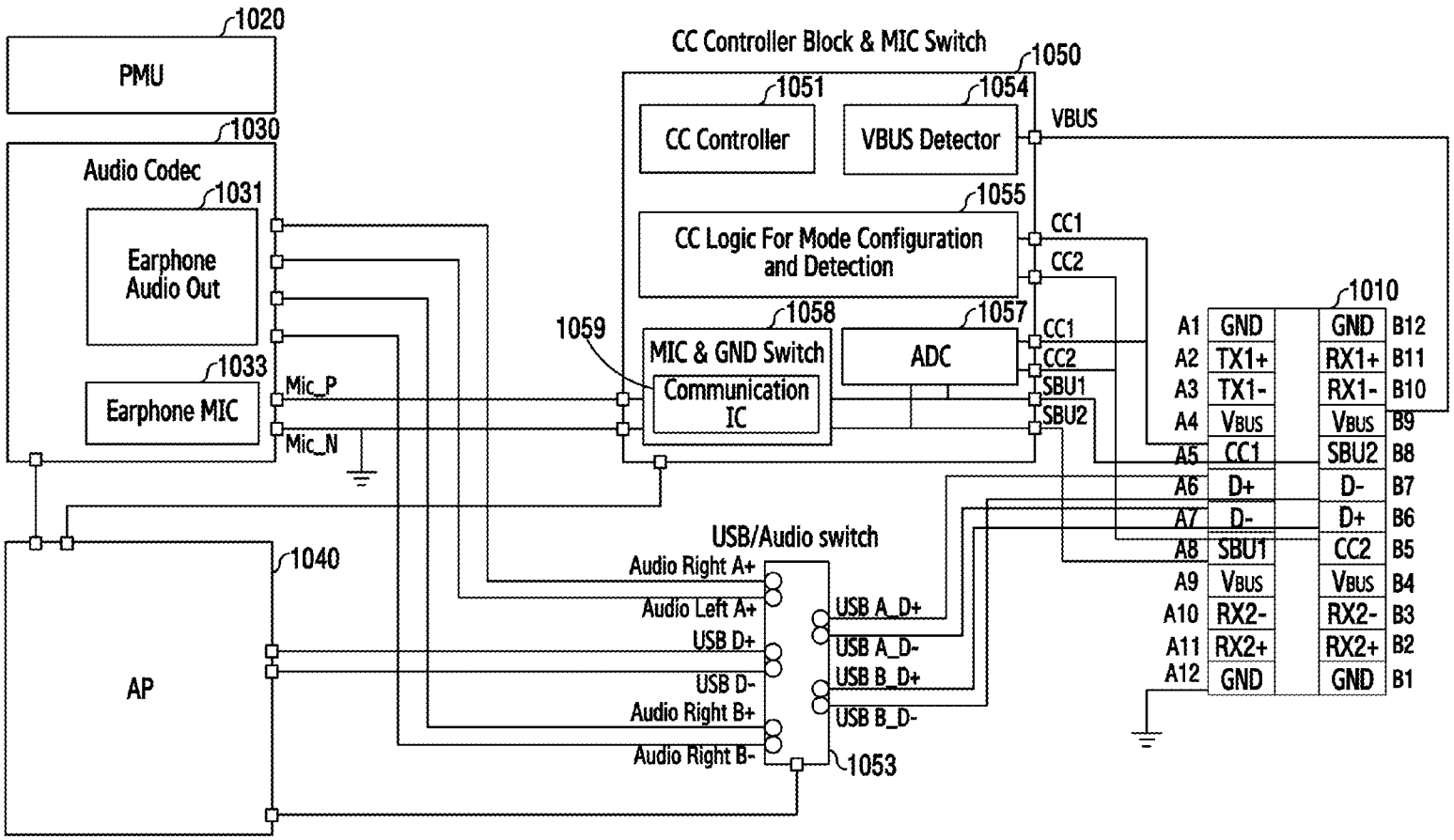
FIG. 10 is a block diagram of an electronic device according to an embodiment of the present disclosure of the present disclosure.

FIG. 10 is a block diagram of an electronic device according to another embodiment of the present disclosure of the present disclosure.

Components of an electronic device 1001 of FIG. 10 may be the same as or similar to at least part of the component of the electronic device 901 of FIG. 9.

The electronic device (host device) 1001 includes a PMU 1020, an audio codec 1030, an AP 1040, a CC controller block/MIC switch 1050, a USB/audio signal switch 1053, and a receptacle 1010.

Compared with the CC controller block/MIC switch 950 of FIG. 9, the CC controller block/MIC switch 1050 may further include a communication IC 1059.

The communication IC 1059 may communicate with the external device through the SBU ports A8 and B8 and thus detect the type of the external device connected to the electronic device (host device) 1001. For example, the communication IC 1059 may transceive signals including at least one of an audio output method, a type, a vendor, and a unique number by communicating with the external device through the SBU port. For example, the communication IC 1059 may authenticate the vendor by communicating with the external device through the SBU port. When authenticating the vendor, the communication IC 1059 may communicate with an external device (or product) of a particular vendor.

The communication IC 1059 may concurrently detect the external device type and authenticate the vendor.

In FIG. 10, the communication IC 1059 is included in, but is not limited to, the CC controller block/MIC switch 1050. For example, the communication IC 1059 may be included in the electronic device 1001 separately from the CC controller block/MIC switch 1050 or the microphone/GND switch 1059.

According to an embodiment of the present disclosure, an electronic device may include a housing, an opening formed on a side of the housing, a hole connected to the opening, a receptacle disposed inside the hole, having a structure for receiving an external connector, and including a plurality of pins, a memory, a processor electrically coupled to the memory, and a circuit electrically coupled to the processor and the receptacle. When the external connector is inserted into the receptacle, the circuit may receive a signal and/or a current through at least one of the pins, and select one of audio signal processing methods provided to the external connector through the receptacle at least based on the received signal and/or current.

The memory may store instructions, which when executed, cause the processor to process an audio signal according to the selected method and to provide the processed audio signal to the external connector through the receptacle.

The external connector may be wired to an external audio device including a first speaker and a second speaker, and the instructions, when executed, may cause the processor to provide the processed audio signal to the first speaker and the second speaker through two of the pins.

When the external connector is inserted into the receptacle, the circuit may receive another audio signal from the external audio device through another one of the pins.

When the external connector is inserted, the instructions, when executed, may cause the processor to electrically connect two of the pins and two other pins which are symmetrical to the two pins in at least one orientation, and to provide the processed audio signal to the first speaker and the second speaker through the two pins and the two other pins.

The two pins may be disposed in proximity.

The external connector may be wired to an external audio device including a first speaker and a second speaker, and the instructions may cause the processor to provide a first audio output to the first speaker through a first pin of the pins and a second pin which is symmetrical to the first pin in at least one orientation, and to provide a second audio output to the second speaker through a third pin of the pins and a fourth pin which is symmetrical to the third pin in at least one orientation.

The first audio output may include a first audio output signal provided to the first speaker through the first pin and a second audio output signal provided to the first speaker through the second pin, and the first audio output signal may be a phase-inverted signal of the second audio output signal.

The circuit may measure an impedance of at least one of the pins based on the received signal and/or current, and select one of the processing methods based on at least part of the measured impedance.

The circuit may obtain identification information of the external connector based on the received signal and/or current, and select one of the processing methods based on at least part of the obtained identification information.

The identification information may include at least one of an audio output method, a type, a vendor, and a unique number of the external connector.

The audio signal may be one of an unbalanced audio signal, a balanced audio signal, a dual channel stereo audio signal, and a 4-channel audio signal.

The electronic device may further include a switch for switching between a digital signal and an audio signal, and the switch may include a 3:2 multiplexer.

The external connector may be a splitter including a receptacle for connecting to at least one external device and a charging device, and the memory may store instructions, which when executed, cause the processor to send the audio signal to at least one external device through the splitter and to receive power from the charging device.

Figure 11:
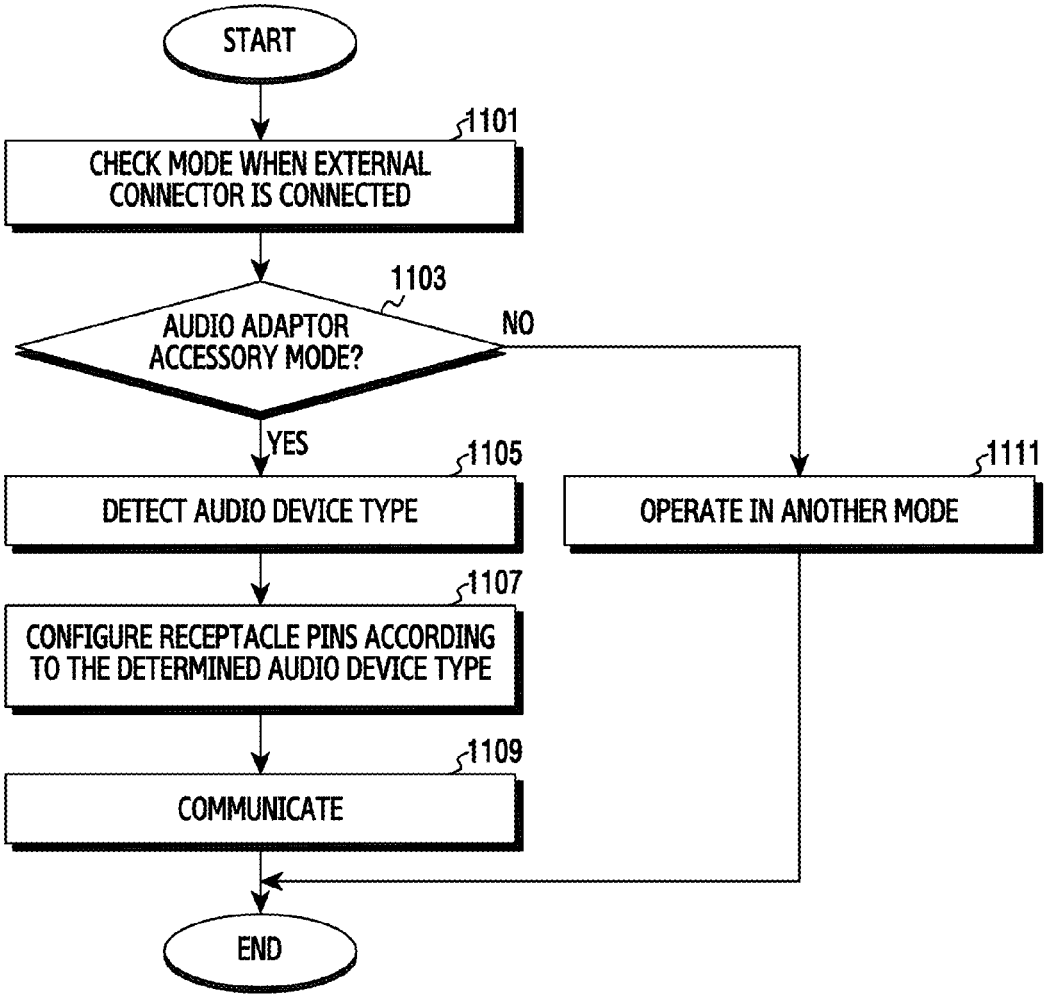
FIG. 11 is a flowchart of an audio signal controlling method according to an embodiment of the present disclosure.

FIG. 11 is a flowchart of an audio signal controlling method according to an embodiment of the present disclosure.

When the external connector (or the external device) is connected to the electronic device 101, the USB controller 850 checks the operation mode of the electronic device 101 in step 1101.

The USB controller 850 may obtain the CC signal received through the CC port and thus detect at least one of the connection of the external device, the operation mode of the electronic device 101, and the connection orientation of the connected external device.

For example, the USB controller 850 may detect at least one (or a connection state) of the connection of the external device, the operation mode of the electronic device 101, and the connection orientation of the connected external device, at least based on the CC signals CC1 and CC2 as shown in Table 1.

TABLE 1

| CC1 | CC2 | State |
|---|---|---|
| Open | Open | Nothing attached |
| Rd | Open | Sink attached |
| Open | Rd | |
| Open | Ra | Powered cable without Sink attached |
| Ra | Open | |
| Rd | Ra | Powered cable without Sink or VCONN-powered |
| Ra | Rd | Accessory attached |
| Rd | Rd | Debug Accessory Mode attached |
| Ra | Ra | Audio Adapter Accessory Mode attached |

As shown in Table 1, the USB controller 850 may detect the connection state between the electronic device 101 and the external connector (or the external device) based on the CC signals. When the CC1 and the CC2 are open/open, the electronic device 101 and the external device are not connected.

When the CC1 and the CC2 are pull-down (Rd)/open or open/pull-down (Rd), the electronic device 101 and the external device (or a sink device) may be connected as host-to-slave (DFP-to-UFP) or slave-to-host (UFP-to-DFP). When the CC1 and the CC2 are pull-down (Rd)/open or open/pull-down (Rd), the electronic device 101 may transceive digital signals with the external device. For example, the AP 840 may transceive digital signals with the external device through the USB/audio signal switch 853 and the data ports D+ and D1 of the receptacle 810.

When a voltage due to a resistance (e.g., Ra) of the cable is applied to the CC1 or the CC2 and the other is open, the electronic device 101 may be connected to a powered cable without the connection with the external device (or the sink device).

When the voltage from the resistance (e.g., Ra) of the cable is applied to the CC1 or the CC2 and the other is pull-down, the electronic device 101 may be connected to the powered cable or a power supply device through the Vconn port.

When both of the CC1 and the CC2 are pull-down, the electronic device 101 may operate in a predefined debug accessory mode.

When the voltage from the resistance (e.g., Ra) of the cable is applied to both the CC1 and the CC2, the electronic device 101 may operate in the audio adaptor accessory mode. For example, the USB controller 850 may detect connection of a device which inputs/outputs analog audio signals through the receptacle 810.

The CC controller 851 may detect the connection state of the electronic device 101 by checking a voltage range as shown in Table 2.

TABLE 2

| | Minimum Voltage | Maximum Voltage | Threshold Voltage |
|---|---|---|---|
| Powered cable/adapter (VRa) | 0.00 V | 0.15 V | 0.20 V |

TABLE 2-continued

| | Minimum Voltage | Maximum Voltage | Threshold Voltage |
|---|---|---|---|
| Sink (VRd) | 0.25 V | 1.50 V | 1.60 V |
| No connect(Vopen) | 1.65 V | — | — |

As shown in Table 2, the USB controller 850 may detect the connection state (or the operation mode) between the electronic device 101 and the external device by determining the voltage range corresponding to the voltage value received through the CC port. When the voltage value received from the CC port corresponds to 0.00 V (Volts) through 0.15 V, the USB controller 850 may determine that the electronic device 101 operates in the audio adaptor accessory mode. For example, the USB controller 850 may detect that the electronic device 101 is connected to the analog audio device. When the voltage value received through one (e.g., the CC1 or the CC2) of the CC ports corresponds to 0.25 V through 1.50 V and the voltage value received through the other (e.g., the CC2 or the CC1) of the CC ports corresponds to 1.65 V, the USB controller 850 may detect that the electronic device 101 is connected to the external device (the sink device). When detecting the voltage value of 1.65 V through the CC port, the USB controller 850 may detect that the electronic device 101 is not connected to the external device. A threshold voltage value may be used to determine a voltage level of voltage values VRa, VRd, and Vopen.

The USB controller 850 may detect the connection orientation or the cable twist of the external connector. When the electronic device 101 is connected with the sink device or the powered cable, the USB controller 850 may detect the connection orientation of the external connector to the receptacle 810 of the electronic device 101 at least based on the voltage values received through the CC1 port and the CC2 port. When the external device connected to the electronic device 101 is a balanced audio device or an unbalanced audio device (e.g., an audio device supporting only the USB 2.0 Type-C standard, a dual channel stereo audio device, a 4-channel audio device, etc.), the USB controller 850 cannot detect the connection orientation of the external connector to the receptacle 810 of the electronic device 101. When the external device connected to the electronic device 101 is a balanced audio device or an unbalanced audio device (e.g., an audio device supporting only the USB 2.0 Type-C standard, a dual channel stereo audio device, a 4-channel audio device, etc.), the USB controller 850 does not need to detect the connection orientation because analog balanced audio signals may be transceived regardless of the connection orientation of the external connector to the receptacle 810 of the electronic device 101.

The USB controller 850 may detect an initial power supply relation (or power supply flow) between the electronic device 101 and the external device.

The USB controller 850 may set the initial connection relation between the electronic device 101 and the external device. For example, the electronic device 101 and the external device are connected through a USB interface, they may operate as a host (e.g., DFP) and a device (or a slave (e.g., UFP)). The host and the device may be determined through the CC port (e.g., CC1 or CC2) of the USB interface. The connection method using the USB interface includes the CC1 and CC2 for the connector attach orientation detection and the digital data communication and defines the host (DFP) role and the device (UFP) role according to the pull-up (Rp) or current sourcing and the pull-down (Rd). The USB interface defines the pull-down (Rd) side as the device (UFP), and the host (DFP) may supply the power through the power supply pin (e.g., VBUS, VCONN) when the device (UFP) requires the power. According to an embodiment of the present disclosure, beside the host (DFP) and the device (UFP), the electronic device 101 and the external device may operate as the DRP. The DRP may indicate the mode (function) for adaptively switching the role of the host (DFP) and the device (UFP). The USB controller 850 may switch to the host (DFP) or the device (UFP) by toggling the pull-up and the pull-down of the CC port.

The USB controller 850 may determine whether the external device is connected at least based on the signal received through the VBUS port. For example, the USB controller 850 may determine whether the external device is connected or disconnected, based on the voltage value received through the VBUS port.

When the operation mode of the electronic device 101 is the audio adaptor accessory mode (or when the electronic device 101 is connected to the analog audio device) in step 1103, the USB controller 850 determines a type of analog audio device connected to the electronic device 101 in step 1105.

Figure 12:
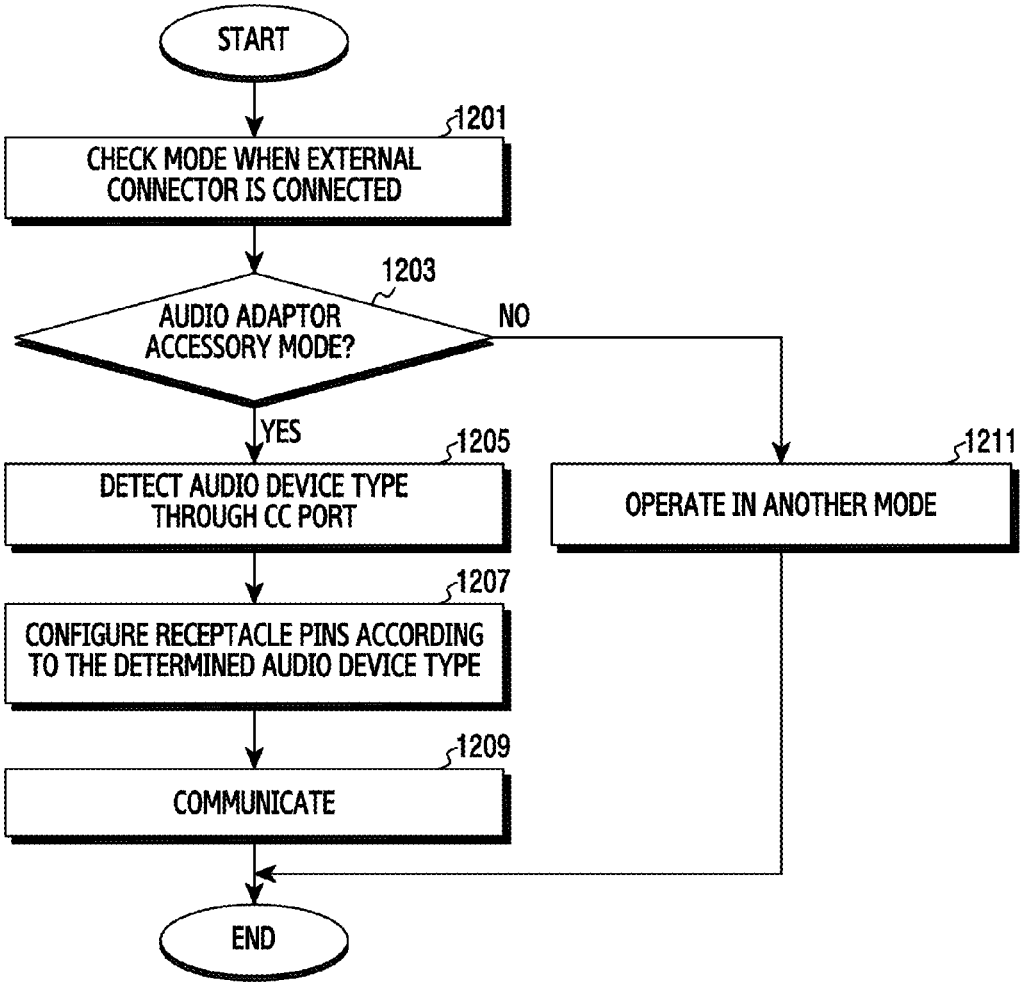
FIG. 12 is a flowchart of an audio signal controlling method according to an embodiment of the present disclosure of the present disclosure.

For example, the USB controller 850 may determine the type of analog audio device connected to the electronic device 101, at least based on the CC signal received through the CC port, which shall be described in more detail by referring to FIG. 12.

Figure 13:
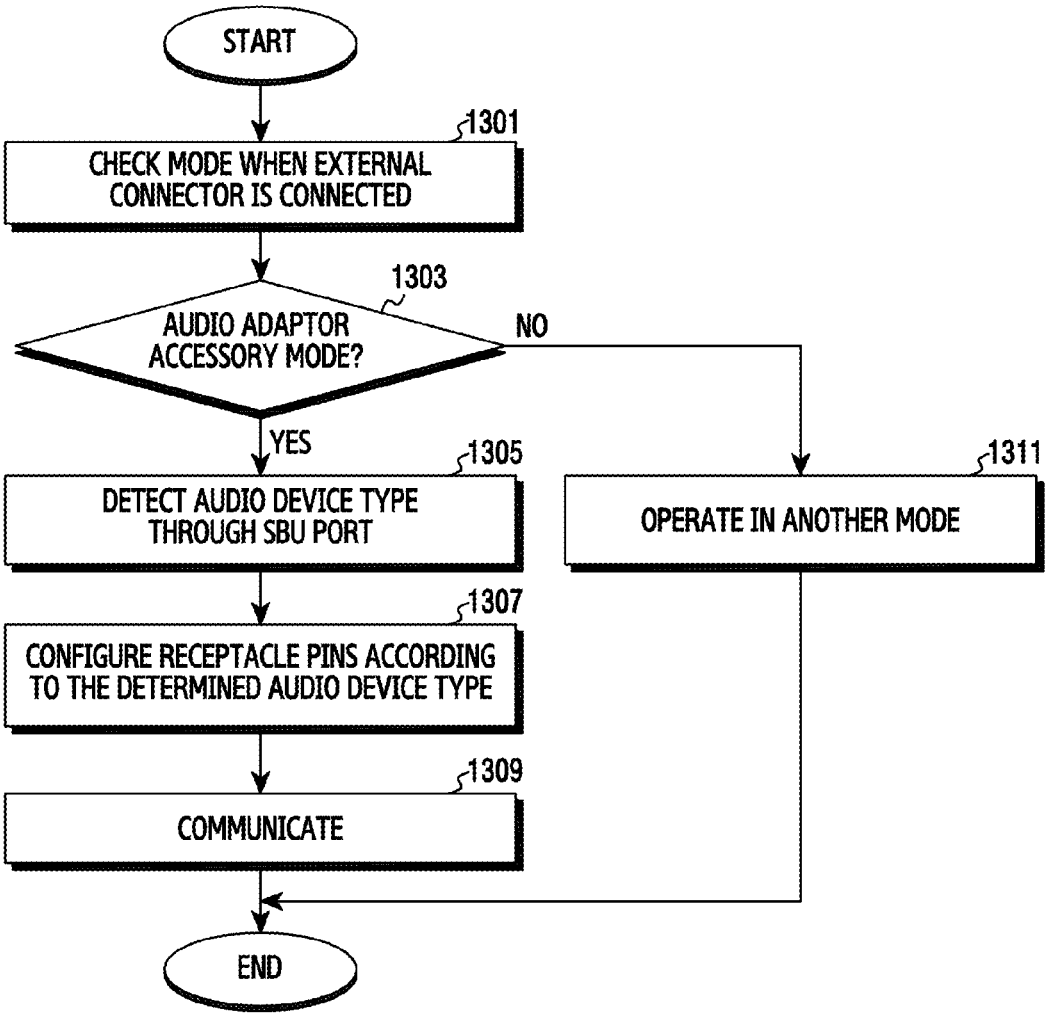
FIG. 13 is a flowchart of an audio signal controlling method according to an embodiment of the present disclosure of the present disclosure.

For example, at least based on the SBU signal received through the SBU port, the USB controller 850 may determine the type of the analog audio device connected to the electronic device 101, which shall be described in more detail by referring to FIG. 13.

Figure 14:
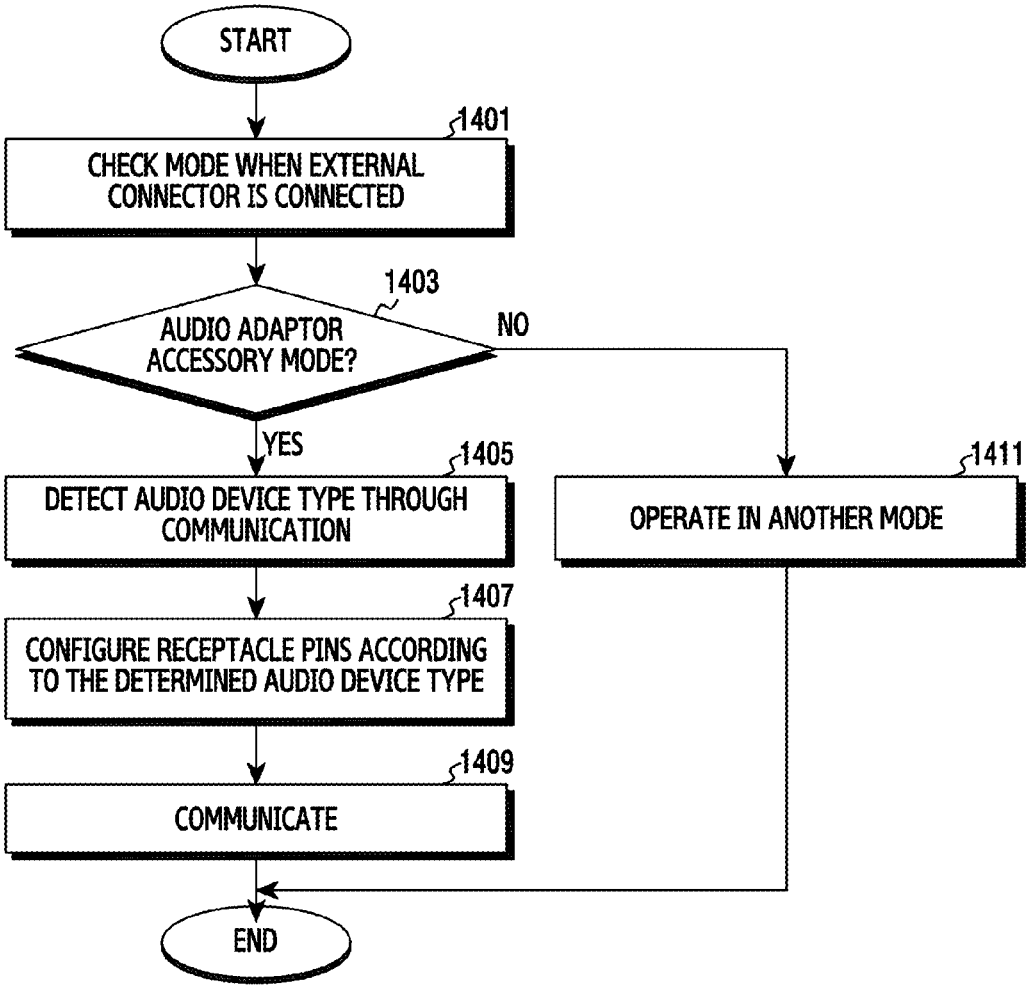
FIG. 14 is a flowchart of an audio signal controlling method according to an embodiment of the present disclosure of the present disclosure.

For example, the USB controller 850 may determine the type of the external device by communicating with the external device connected to the electronic device 101 using the communication IC, which shall be described in more detail by referring to FIG. 14.

Figure 15:
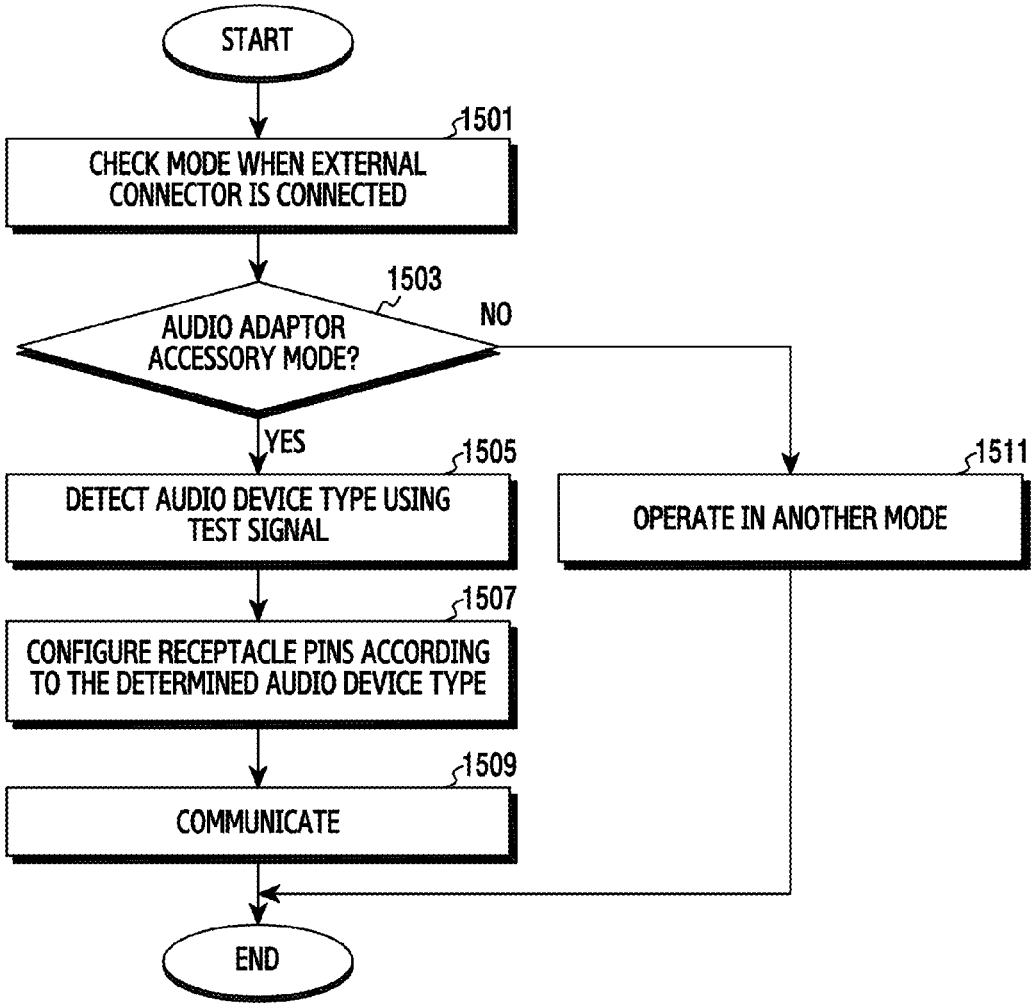
FIG. 15 is a flowchart of an audio signal controlling method according to an embodiment of the present disclosure of the present disclosure.

For example, the AP 840 may determine the type of the audio device by sending a test signal (or a pilot tone) generated in the audio codec 830 and determining a test signal level or amplitude received from the external device, which shall be described in more detail by referring to FIG. 15 and FIG. 16.

The present disclosure is not limited to the above-stated methods for determining the type of the analog audio device. In step 1107, the AP 840 configures (or defines) the pins of the receptacle 810 according to the determined audio device type.

For example, the AP 840 may configure the pins of the receptacle 810 as shown in Table 3.

TABLE 3

| Plug Pin | USB Name | Original Audio Function | 1st Balanced Audio Function | 2nd Balanced Audio Function |
|---|---|---|---|---|
| A5 | CC | | | |
| B5 | Vconn | | | |
| A6 | Dp | right | right+ | right− |
| B6 | Dp | right | right− | right+ |
| A7 | Dn | left | left+ | left− |
| B7 | Dn | left | left− | left+ |
| A8 | SBU1 | Mic/AGND | Mic/AGND | Mic/AGND |
| B8 | SBU2 | AGND/Mic | AGND/Mic | AGND/Mic |

TABLE 3-continued

| Plug Pin | USB Name | Original Audio Function | 1st Balanced Audio Function | 2nd Balanced Audio Function |
|---|---|---|---|---|
| A1/A12 B1/B12 | GND | GND for Shield | GND for Shield | GND for Shield |
| A4/A9 B4/B9 | VBUS | | | |

As shown in Table 3, when the electronic device 101 is connected to an unbalanced audio device, the AP 840 may set (or assign) the right signal to the Dp ports (or D+ port A6 and B6) and set (or assign) the left signal to the Dn ports (or D− ports A7 and B7) so as to perform an original audio function (e.g., USB 2.0 Type-C standard).

When the electronic device 101 is connected to a balanced audio device, the AP 840 may set (or assign) the right+ signal to the A6 pin, the right− signal to the B6 pin, the left+ signal to the A7 pin, and the left− signal to the B7 pin so as to perform a first balanced audio function (e.g., USB 3.1 Type-C standard).

When the electronic device 101 is connected to a balanced audio device, the AP 840 may set (or assign) the right− signal to the A6 pin, the right+ signal to the B6 pin, the left− signal to the A7 pin, and the left+ signal to the B7 pin so as to perform a second balanced audio function (e.g., USB 3.1 Type-C standard).

According to an embodiment of the present disclosure, the AP 840 may set (or assign) the microphone signal Mic and the AGND signal to the A8 and the B8 respectively, regardless of the type of the analog audio device. The AP 840 may set (or assign) the AGND signal and the Mic signal to the A8 and the B8 respectively, regardless of the type of analog audio device.

The A5 pin may be configured to detect a CC value for detecting the external device. The B5 pin may be set to Vconn used to supply the power. For example, when the CC pins of the receptacle 810 of the electronic device 101 detect the pull-down, one of the CC pins may be switched from the pull-up to Vconn.

The A1/A12 and B1/B12 pins are used as a digital ground (DGND) and may return the current to the CC1, the CC2, and the VBUS.

The A4/A9 and B4/B9 pins may be used for the power supply. For example, to charge a battery of the electronic device 101, the power of 5V and 500 mA may be supplied through the A4/A9 and B4/B9 pins. According to an embodiment of the present disclosure, when the A4/A9 and B4/B9 pins are not used for the power supply, no signals may be transceived through the A1/A9 and B1/B9 pins.

Since the other pins, for example, the pins A2 (TX1+), A3(TX1−), A10(RX2−), A11(RX2+), B2(TX2+), B3(TX2−), B10(RX1−), and B11 (RX1+) are for the high-speed transmission of the digital data signals, the A2, A3, A10, A11, B2, B3, B10, and B11 pins may not be configured when the analog audio device is connected.

The AP 840 may configure (or define) the pins of the receptacle 810 so as to support the dual channel stereo audio or the 4-channel audio.

For example, the AP 840 may configure the pins of the receptacle 810 as shown in Table 4.

TABLE 4

| Plug Pin | USB Name | Dual Channel Stereo Audio Function | 4-Channel Audio Function |
|---|---|---|---|
| A5 | CC | | |
| B5 | Vconn | | |
| A6 | Dp | right A channel | right front |
| B6 | Dp | right B channel | right rear |
| A7 | Dn | left A channel | left front |
| B7 | Dn | left B channel | left rear |
| A8 | SBU1 | Mic/AGND | Mic/AGND |
| B8 | SBU2 | AGND/Mic | AGND/Mic |
| A1/A12 B1/B12 | GND | GND for shield | GND for shield |
| A4/A9 B4/B9 | VBUS | | |

As shown in Table 4, to support the dual channel stereo audio, the AP 840 may set, but is not limited to, the right A channel to the A6 pin, the right B channel to the B6 pin, the left A channel to the A7 pin, and the left B channel to the B7 pin so as to output the corresponding audio. For example, the AP 840 may set the right B channel to the A6 pin, the right A channel to the B6 pin, the left B channel to the A7 pin, and the left A channel to the B7 pin so as to output the corresponding audio. As the AP 840 configures the pins so transceive the audio signals corresponding to the A channel and the B channel using the four data pins A6, B6, A7, and B7, the electronic device 101 may support two different stereo audio outputs.

To support the 4-channel audio output, the AP 840 may set, but is not limited to, right front to the A6 pin, right rear to the B6 pin, left front to the A7 pin, and left rear to the B7 pin so as to output the corresponding audio. For example, the AP 840 may set right rear to the A6 pin, right front to the B6 pin, left rear to the A7 pin, and left front to the B7 pin so as to output the corresponding audio.

In step 1109, the AP 840 enables the electronic device 101 to communicate with the connected audio device.

The AP 840 may enable the electronic device 101 to communicate with the connected audio device by controlling the switching of the USB/audio signal switch 853. For example, the AP 840 may control the switching of the USB/audio signal switch 853 so as to transceive the corresponding audio according to the type of the audio device connected to the electronic device 101, which are described in more detail by referring to FIGS. 18 through 21.

In step 1111, the AP 840 enables the electronic device 101 to operate in a different mode from the audio adaptor accessory mode.

When the electronic device 101 is connected with a device (e.g., the sink device) supporting digital signals, the AP 840 may transmit and receive digital signals through the data pins A6, B6, A7, and B7 of the receptacle 810.

According to an embodiment of the present disclosure, the AP 840 may enable the electronic device 101 to operate in, but is not limited to, the debug accessory mode.

In FIG. 11, checking the mode of the electronic device 101 when the external connector is connected in the step 1101 and determining the type of the audio device in the step 1105 are carried out, but is not limited to, separately and the steps may be combined. For example, checking the mode of the electronic device 101 when the external connector is connected in the step 1101 and determining the type of the audio device in the step 1105 may be performed at the same time. For example, when detecting that the CC signal (the voltage value received through the CC port) corresponds to a preset range, the USB controller 850 may determine the mode of the electronic device 101 and the type of the audio device connected to the electronic device 101.

FIG. 12 is a flowchart of an audio signal controlling method according to another embodiment of the present disclosure.

Referring to FIG. 12, at least part of steps 1201, 1203, 1207, 1209, and 1211 are the same as or analogous to at least part of the steps 1101, 1103, 1107, 1109, and 1111 of FIG. 11 and accordingly shall not be described further.

In step 1205, the USB controller 850 may determine the type of analog audio device connected to the electronic device 101 at least based on the CC signal received through the CC port.

The USB controller 850 may determine the type of the audio device, at least based on the voltage value detected by the ADC and received from the CC port. For example, according to whether the range of the voltage value (or the impedance value of VRa) of the impedance of the resistor VRa of the cable corresponds to a specific range preset from 0.00 V to 0.15 V in Table 2, the USB controller 850 may determine whether the connected audio device is, but is not limited to, an analog unbalanced audio device or an analog balanced audio device. By specifying the range of the impedance value of VRa, the AP 840 may identify various types or various audio device types including an active noise control (ANC) audio device and a high fidelity (Hi-Fi) headset.

FIG. 13 is a flowchart of an audio signal controlling method according to another embodiment of the present disclosure.

Referring to FIG. 13, at least part of steps 1301, 1303, 1307, 1309, and 1311 are the same as or analogous to at least part of the steps 1101, 1103, 1107, 1109, and 1111 of FIG. 11 and accordingly shall not be described further.

When the operation mode of the electronic device 101 is the audio adaptor accessory mode (or when the electronic device 101 is connected with the analog audio device) in step 1303, the USB controller 850 determines the type of the analog audio device connected to the electronic device 101 at least based on the SBU signal received through the SBU port in step 1305. For example, the USB controller 850 may identify the type of the external device connected to the electronic device 101 by confirming the audio accessory ID (or the audio accessory ID impedance value) of the SBU signal.

The USB controller 850 may obtain a digital value of the audio accessory ID converted by the ADC 957 from an analog value.

When a microphone is connected to one of the SBU ports, for example, the SBU1 port and the SBU2 port is connected, the USB controller 850 may obtain the audio accessory ID received through the unconnected SBU port and thus detect the type of the external device connected to the electronic device 101.

FIG. 14 is a flowchart of an audio signal controlling method according to another embodiment of the present disclosure.

Referring to FIG. 14, at least part of steps 1401, 1403, 1407, 1409, and 1411 are the same as or analogous to at least part of the steps 1101, 1103, 1107, 1109, and 1111 of FIG. 11 and accordingly shall not be described further.

In step 1403, the USB controller 850 identifies the type of the external device by communicating with the external device connected to the electronic device 101 using the communication IC 1059. For example, the communication IC 1059 may communicate with the communication IC 1059 of the external device through the SBU port of the receptacle 810.

The communication IC 1059 may transceive signals including at least one of an audio output method, a type, a vendor, and a unique number of the external device in the communication. The communication IC 1059 may authenticate the vendor by communicating with, but is not limited to, the external device through the SBU port. When authenticating the vendor, the communication IC 1059 may communicate with an external device (or a product) of a particular vendor.

The communication IC 1059 may concurrently detect the external device type and authenticate the vendor.

The communication IC 1059 may be included in the USB controller 850. According to an embodiment of the present disclosure, the communication IC 1059 may be included in the electronic device 1001 separately from the USB controller 850.

FIG. 15 is a flowchart of an audio signal controlling method according to another embodiment of the present disclosure.

Figure 16A:
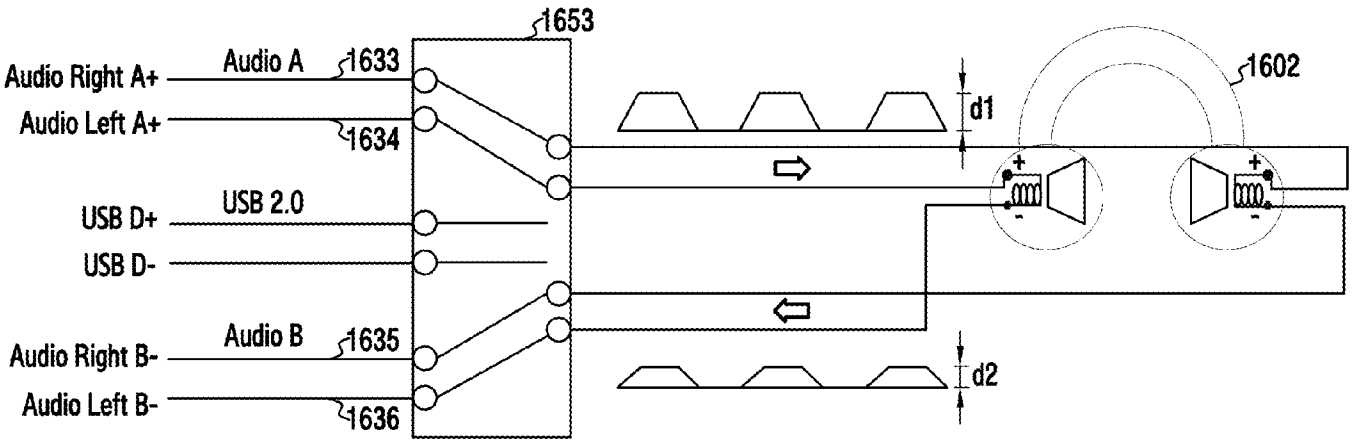
FIGS. 16A and 16B are diagrams of an audio signal controlling method according to an embodiment of the present disclosure of the present disclosure.
Figure 16B:
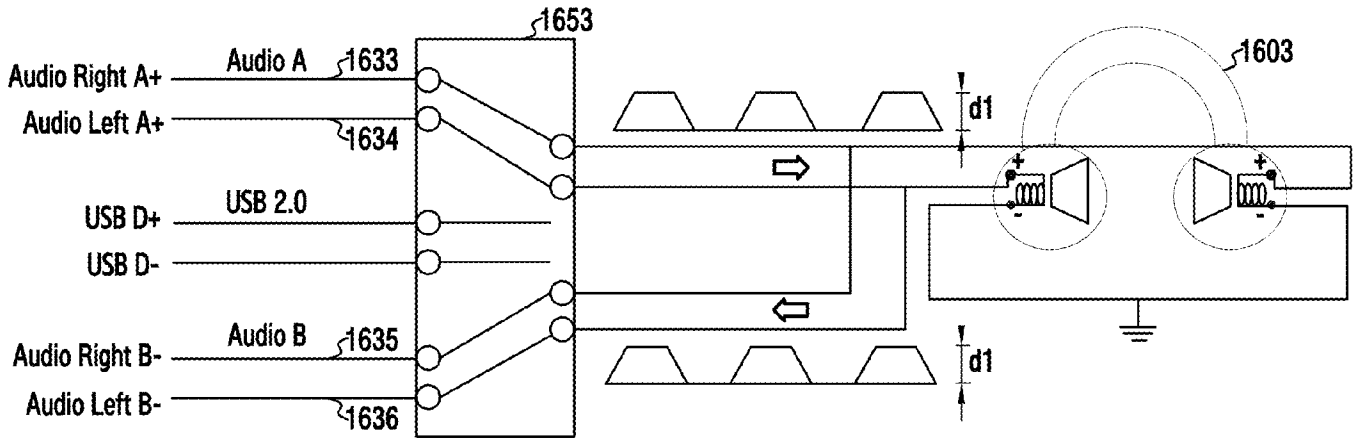

FIGS. 16A and 16B are diagrams of an audio signal controlling method according to another embodiment of the present disclosure.

Referring to FIG. 15, at least part of steps 1501, 1503, 1507, 1509, and 1511 are the same as or analogous to at least part of the steps 1101, 1103, 1107, 1109, and 1111 of FIG. 11 and accordingly shall not be described further.

In step 1505, the AP 840 sends a test signal (or pilot tone) generated by the audio codec 830 to the external device, checks a test signal level (or amplitude) received from the external device, and thus determines the type of the audio device.

The external device is a balanced audio device in FIG. 16A, and the external device is an unbalanced audio device in FIG. 16B.

In FIG. 16A, the audio codec 830 may generate the test signal and send the generated test signal to a USB/audio signal switch 1653 through paths 1633 and 1634 corresponding to the A channel. The USB/audio signal switch 1653 may send the test signal to a balanced audio signal 1602 through the A pins (e.g., A6 and B) of the receptacle. An amplitude of the test signal sent to the balanced audio signal 1602 may be d1. The USB/audio signal switch 1653 may receive a test signal output from the balanced audio signal 1602, and send the received output to the audio codec 830 through paths 1635 and 1636 corresponding to the B channel. An amplitude of the test signal received from the balanced audio signal 1602 may be d2. In the balanced audio signal 1602, the amplitude d1 of the test signal input to the balanced audio signal 1602 may be different from the amplitude d2 of the test signal output from the balanced audio signal 1602. For example, the amplitude d1 of the test signal input to the balanced audio signal 1602 may be greater than the amplitude d2 of the test signal output from the balanced audio signal 1602. The amplitude d2 of the test signal output from the balanced audio signal 1602 may be smaller than the amplitude d1 of the test signal input to the balanced audio signal 1602 due to an impedance of the balanced audio signal 1602.

At least based on the amplitude information of the test signal from the audio codec 830, the AP 840 may check a difference between the test signal amplitude d1 and the test signal amplitude d2 and thus determine that the device connected to the electronic device 101 is the balanced audio signal 1602.

In FIG. 16B, the audio codec 830 may generate the test signal and send the generated test signal to the USB/audio signal switch 1653 through the paths 1633 and 1634 corresponding to the A channel. The USB/audio signal switch 1653 may send the test signal to an unbalanced audio signal 1603 through the A pins (e.g., A6 and B) of the receptacle. The amplitude of the test signal sent to the unbalanced audio signal 160 may be d1. The USB/audio signal switch 1653 may receive a test signal output from the unbalanced audio signal 1603, and send the received output to the audio codec 830 through the paths 1635 and 1636 corresponding to the B channel. The amplitude of the test signal received from the unbalanced audio signal 1603 may be d2. In the unbalanced audio signal 1603, the amplitude d 1 of the test signal input to the unbalanced audio signal 1603 may be the same as the amplitude d2 of the test signal output from the unbalanced audio signal 1603 in response to the test signal input. Since an A port and a B port of the unbalanced audio device 1603 are shorted, the test signal amplitude d1 input to the unbalanced audio signal 1603 may be the same as the test signal amplitude d2 output from the unbalanced audio signal 1603.

At least based on the amplitude information of the test signal from the audio codec 830, the AP 840 may detect that the amplitudes of the transmit test signal and the received test signal are identical and thus determine that the device connected to the electronic device 101 is the unbalanced audio signal 1603.

Figure 17:
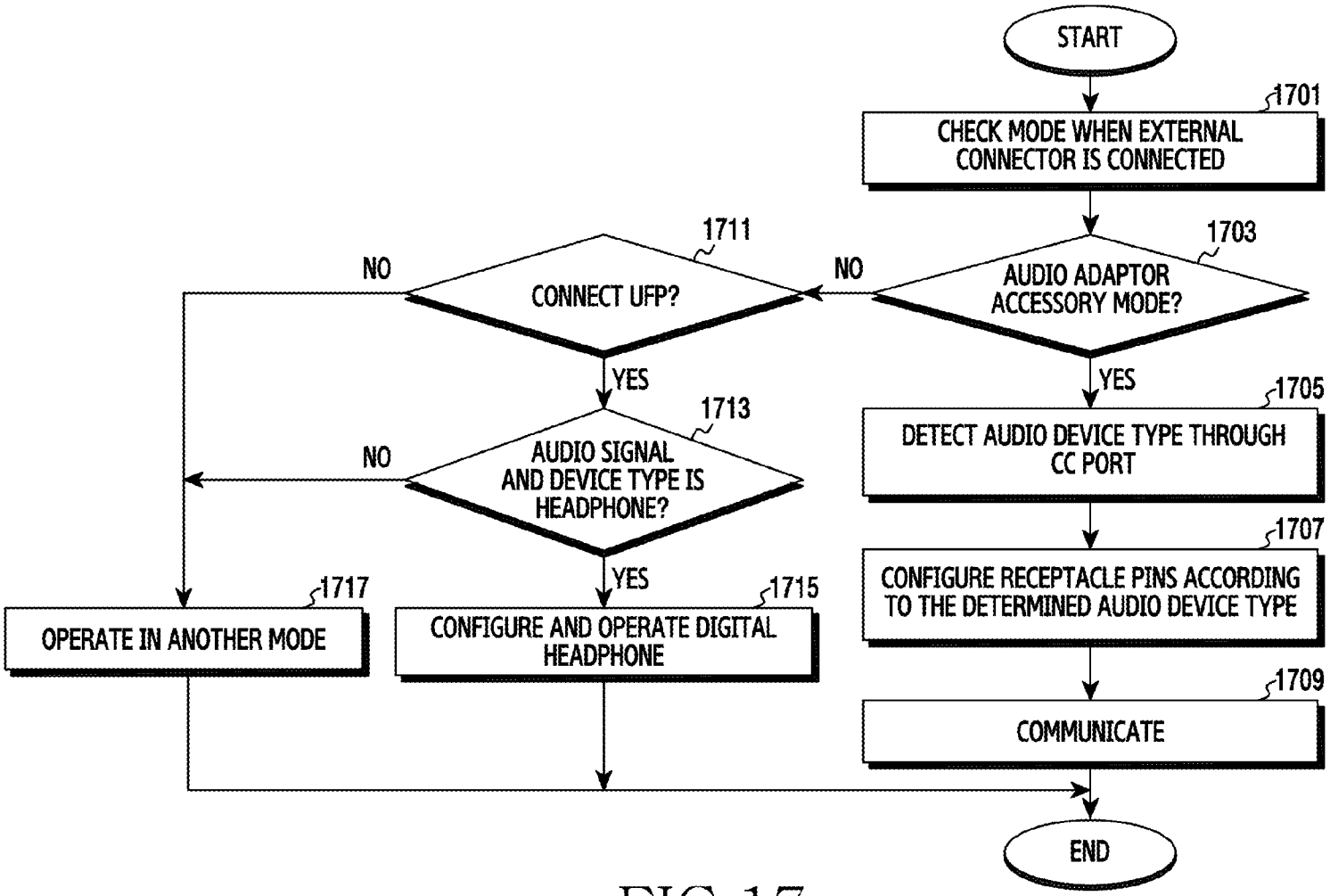
FIG. 17 is a flowchart of an audio signal controlling method according to another embodiment of the present disclosure.

FIG. 17 is a flowchart of an audio signal controlling method according to another embodiment of the present disclosure.

Referring to FIG. 17, at least part of steps 1701, 1703, 1707, 1709, and 1711 are the same as or analogous to at least part of the steps 1101, 1103, 1107, 1109, and 1111 of FIG. 11 and accordingly shall not be described any more.

When the operation mode of the external device is not the audio adaptor accessory mode in step 1703, the USB controller 850 determines whether a device (UFP) is connected to the electronic device 101 in step 1711. The device may be a sink device (e.g., a USB memory).

At least based on CC signals, when CC1 and CC2 are pull-down (Rd)/open or open/pull-down (Rd), the USB controller 850 may detect that the electronic device 101 is connected to the external device (or the sink device).

At least based on the CC signals, when CC1 and CC2 are open/open, the USB controller 850 may detect that the electronic device 101 is not connected to an external device.

At least based on the CC signals, when the resistance (e.g., Ra) of the cable applies the voltage and the other is open, the electronic device 101 may detect that it is connected to a powered cable without the connection with the external device (or the sink device).

When detecting the connection of the electronic device 101 and the external device (or the sink device) in step 1711, the USB controller 850 determines whether the external device attached to the electronic device 101 is a headphone supporting digital audio signals. For example, the USB controller 850 may determine whether the external device attached to the electronic device 101 is the headphone supporting digital audio signals by measuring the CC signals, for example, the voltage value received through the CC ports.

When the external device attached to the electronic device 101 is the headphone (or a digital headphone) supporting digital audio signals in step 1713, the AP 840 controls connection configuration and operation for communicating with the headphone in step 1715. For example, the AP 840 may control the switching of the USB/audio signal switch 853 for communication with the headphone.

When the electronic device 101 is not connected to the external device (or the sink device) in step 1711 or when the connected external device does not correspond to the headphone supporting digital audio signals in step 1713, the AP 840 may operate in another operation mode of the electronic device 101.

For example, the AP 840 may enable the electronic device 101 to operate in the debug accessory mode. For example, the AP 840 may confirm that the electronic device 101 is connected to the powered cable and thus allow, but is not limited to, the charging.

According to an embodiment of the present disclosure, the present method includes, when an external connector is inserted into a receptacle which receives the external connector and includes a plurality of pins, receiving a signal and/or a current through at least one of the pins, and selecting one of audio signal processing methods provided to the external connector through the receptacle at least based on the received signal and/or current.

The method may further include processing an audio signal according to the selected method, and providing the processed audio signal to the external connector through the receptacle.

The external connector may be wired to an external audio device including a first speaker and a second speaker, and the method may further include providing the processed audio signal to the first speaker and the second speaker through two of the pins.

The method may further include, when the external connector is inserted into the receptacle, receiving another audio signal from the external audio device through another one of the pins.

The method may further include, when the external connector is inserted, electrically connecting two of the pins and two other pins which are symmetrical to the two pins in at least one orientation, and providing the processed audio signal to the first speaker and the second speaker through the two pins and the two other pins.

The two pins may be disposed in proximity.

The external connector may be wired to an external audio device including a first speaker and a second speaker, and the method may further include providing a first audio output to the first speaker through a first pin of the pins and a second pin which is symmetrical to the first pin in at least one orientation, and providing a second audio output to the second speaker through a third pin of the pins and a fourth pin which is symmetrical to the third pin in at least one orientation.

The first audio output may include a first audio output signal provided to the first speaker through the first pin and a second audio output signal provided to the first speaker through the second pin, and the first audio output signal may be a phase-inverted signal of the second audio output signal.

The method may further include measuring an impedance of at least one of the pins based on the received signal and/or current, and selecting one of the processing methods based on at least part of the measured impedance.

The method may further include obtaining identification information of the external connector based on the received signal and/or current, and selecting one of the processing methods based on at least part of the obtained identification information.

The identification information may include at least one of an audio output method, a type, a vendor, and a unique number of the external connector.

The audio signal may be one of an unbalanced audio signal, a balanced audio signal, a dual channel stereo audio signal, and a 4-channel audio signal.

The method may further include switching to send and receive a digital signal or the audio signal, and a switch may include a 3:2 multiplexer performs the switching to send and receive the digital signal or the audio signal.

The external connector may be a splitter including a receptacle for connecting to at least one external device and a charging device, and the method may further include sending the audio signal to at least one external device through the splitter and receiving power from the charging device.

FIGS. 18A, 18B, 19A, 19B, 20A, 20B and 21 are diagrams of audio signal controlling according to an embodiment of the present disclosure.

Figure 18B:
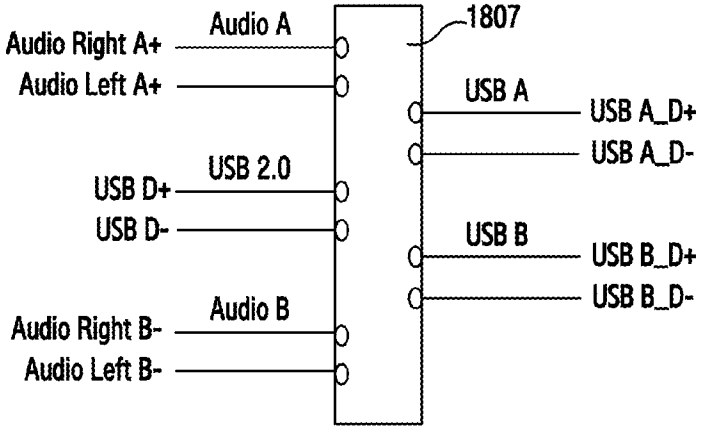
FIGS. 18A and 18B are diagrams of audio signal controlling according to an embodiment of the present disclosure.
Figure 18A:
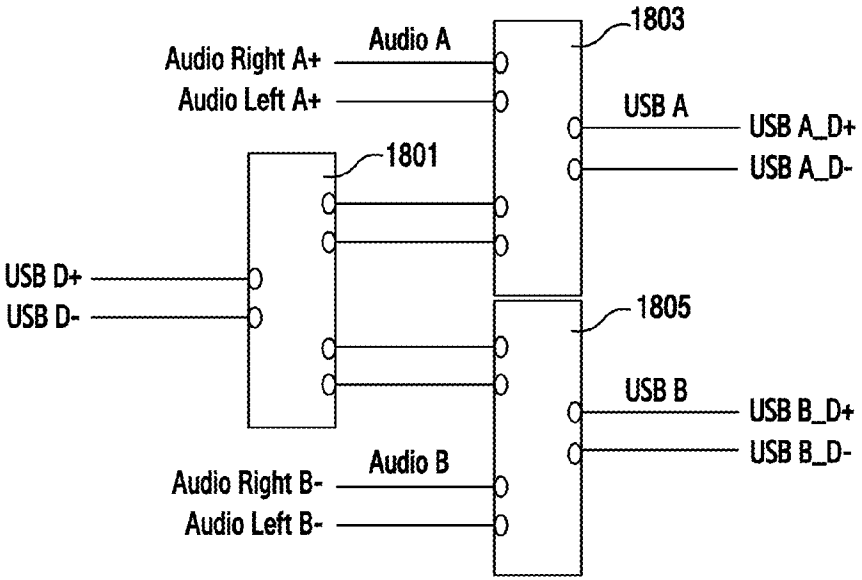

FIGS. 18A and 18B depicts a structure of a USB/audio signal switch, and FIGS. 19A, 19B, 20A, 20B and 21 depict switching of the USB/audio signal switch 853 under the control of the AP 840.

The USB/audio signal switches of FIG. 18A and FIG. 18B may support balanced audio signal output according to an embodiment of the present disclosure.

The USB/audio signal switch of FIG. 18A may include three 2:1 multiplexers (muxes) 1801, 1803, and 1805.

The USB/audio signal switch of FIG. 18B, which is a simplified switch of the USB/audio signal switch of FIG. 18A, may include one 3:2 multiplexers.

Compared with the USB/audio signal switch of FIG. 18A, the USB/audio signal switch 1807 of FIG. 18B may prevent performance degradation with the simplified structure. The switching of the USB/audio signal switch of FIG. 18B is described according to the external device type by referring to FIGS. 19A, 19B and 20.

Figure 19B:
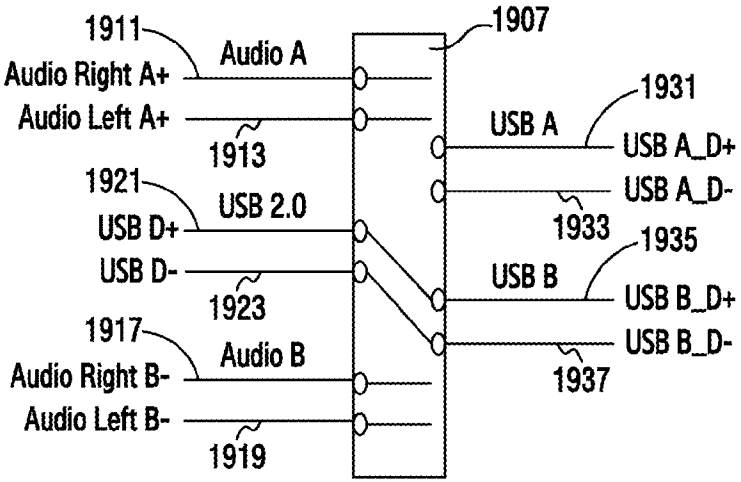
FIGS. 19A and 19B are diagrams of audio signal controlling according to an embodiment of the present disclosure of the present disclosure.
Figure 19A:
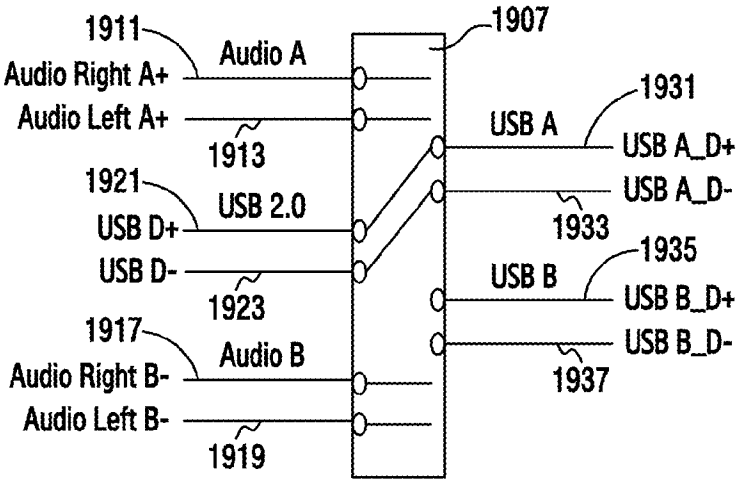

In FIGS. 19A and 19B, when the external device is the sink device, the AP 840 may send a digital data signal to a USB/audio signal switch 1907 through paths 1921 and 1923. Paths 1911, 1913, 1917, and 1919 between the audio codec 830 and the USB/audio signal switch 1907 may be open.

According to a control signal of the AP 840, the USB/audio signal switch 1907 may perform the switching to send the digital data signal to the A pins (or A channel) or the B pins (or B channel).

Based on an external connector orientation of the external device inserted into the receptacle of the electronic device 101, the USB/audio signal switch 1907 may send the digital data signal through the A pins (or the A channel) as shown in FIG. 19A. For example, the USB/audio signal switch 1907 may send the digital data signal to the pins A6 and A7 of the receptacle along paths 1931 and 1933.

According to an embodiment of the present disclosure, based on the external connector orientation of the external device inserted into the receptacle of the electronic device 101, the USB/audio signal switch 1907 may send the digital data signal through the B pins (or the B channel) as shown in FIG. 19B. For example, the USB/audio signal switch 1907 may send the digital data signal to the pins B6 and B7 of the receptacle along paths 1935 and 1937.

Figure 20B:
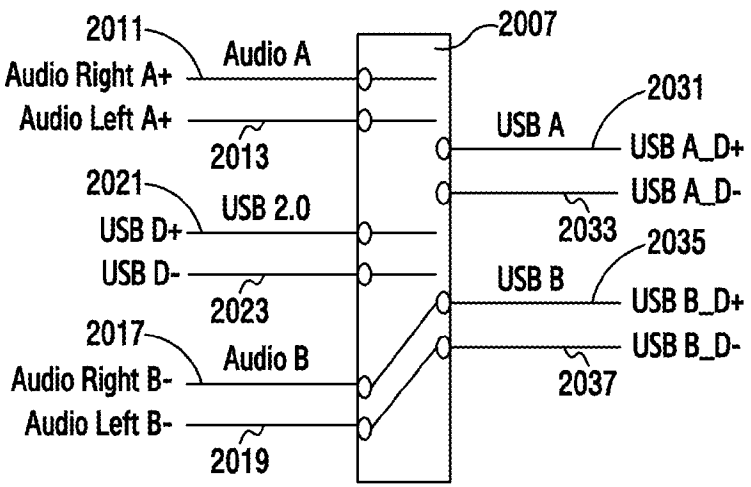
FIGS. 20A and 20B are diagrams of audio signal controlling according to an embodiment of the present disclosure of the present disclosure.
Figure 20A:
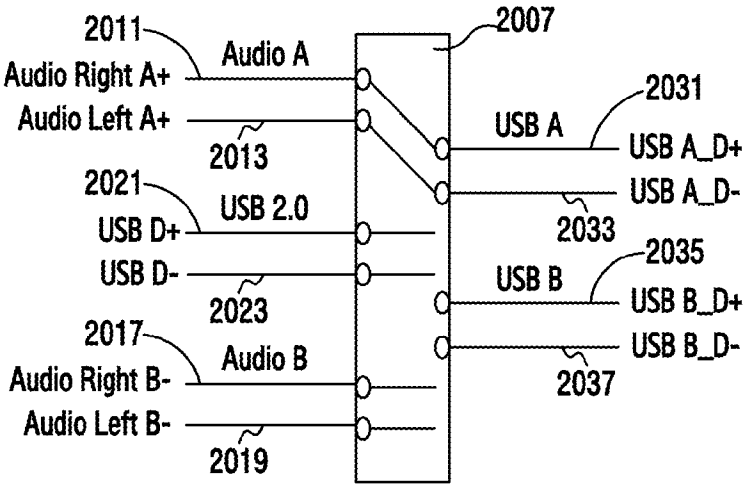

In FIGS. 20A and 20B, when the external device is an analog unbalanced audio device, the audio codec 830 may send an analog data signal to a USB/audio signal switch 2007 through paths 2011, 2013, 2017, and 2019 under the control of the AP 840. Paths between the AP 840 and the USB/audio signal switch may be open.

Under the control of the AP 840, the USB/audio signal switch 2007 may perform the switching to send the analog audio signal to the A pins (or the A channel) or the B pins (or the B channel).

Based on an external connector orientation of the analog unbalanced audio device inserted into the receptacle of the electronic device 101, the USB/audio signal switch 2007 may send the analog data signal through the A pins (or the A channel) as shown in FIG. 20A. For example, the USB/audio signal switch 2007 may send analog audio signals Audio right A and Audio left A to the pins A6 and A7 of the receptacle along paths 2031 and 2033.

According to an embodiment of the present disclosure, based on the external connector orientation of the analog unbalanced audio device inserted into the receptacle of the electronic device 101, the USB/audio signal switch 2007 may send an analog data signal through the B pins (or the B channel) as shown in FIG. 20B. For example, the USB/audio signal switch 2007 may send analog audio signals Audio right B and Audio left B to the pins B6 and B7 of the receptacle along paths 2035 and 2037.

Figure 21:
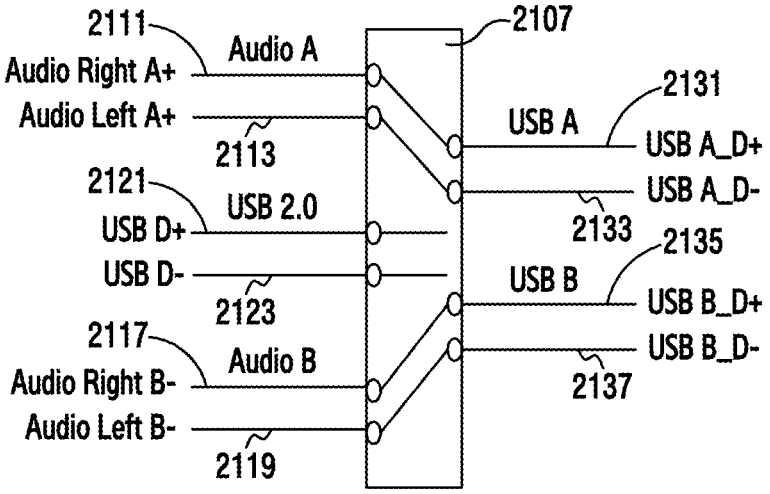
FIG. 21 is a diagram of audio signal controlling according to an embodiment of the present disclosure of the present disclosure.

In FIG. 21, when the external device is an analog balanced audio device, the audio codec 830 may send analog audio signals to a USB/audio signal switch 2107 through paths 2111, 2113, 2117, and 2119 under the control of the AP 840. Paths 2121 and 2123 between the AP 840 and the USB/audio signal switch may be open.

According to a control signal of the AP 840, the USB/audio signal switch 2107 may perform the switching to send the analog audio signals to the A pins (or the A channel) or the B pins (or the B channel) along the paths 2131, 2133, 2135, and 2137.

Regardless of the external connector orientation of the analog balanced audio device inserted into the receptacle of the electronic device 101, the USB/audio signal switch 2107 may send analog audio signals audio right A+ and audio left A+ through the A pins (or the A channel) and send analog audio signals audio right B− and audio left B− through the B pins (or the B channel) as shown in FIG. 21.

Figure 22:
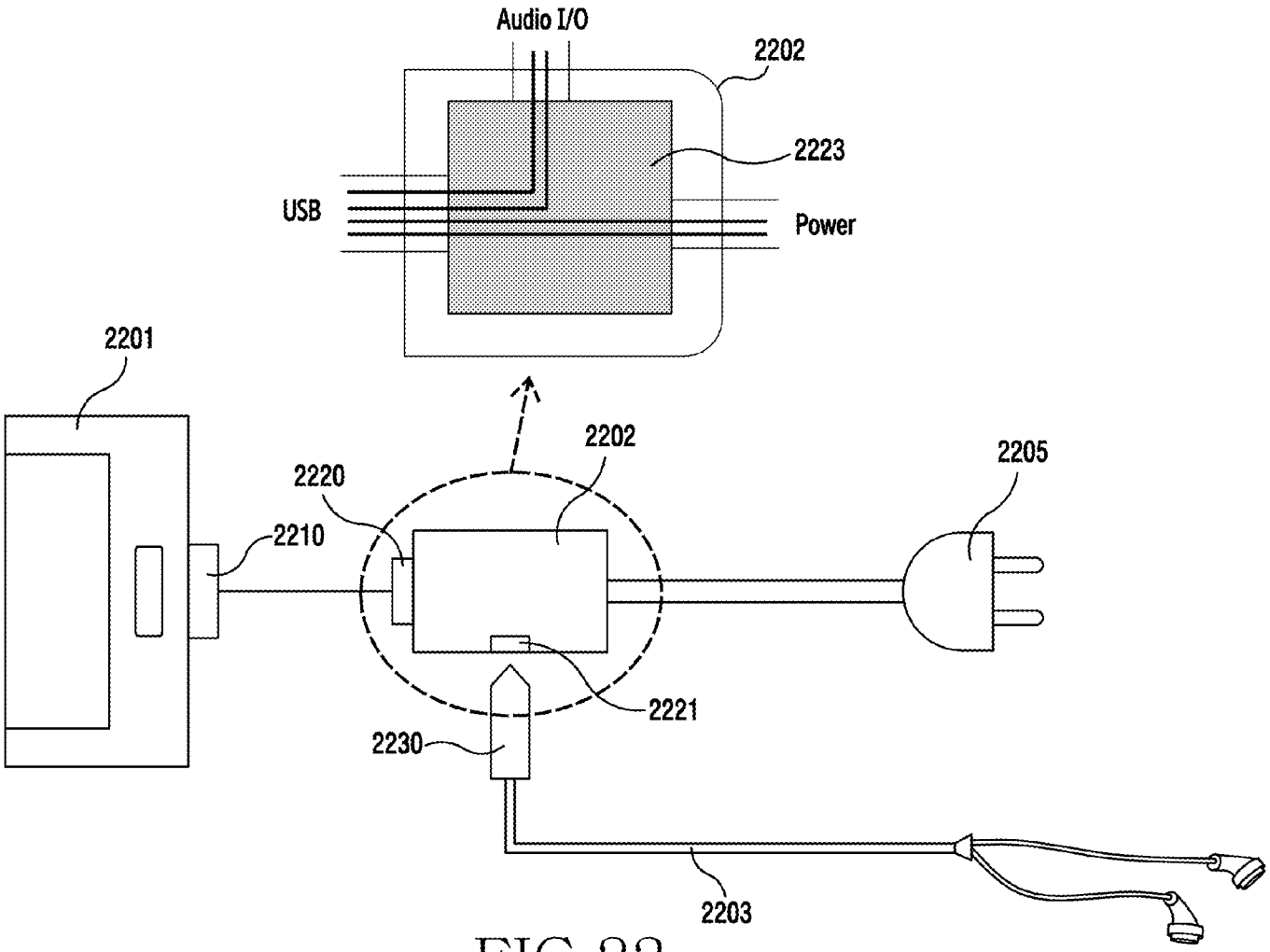
FIGS. 22 and 23 are diagrams of audio signal and power transmitted and received in an electronic device according to an embodiment of the present disclosure.
Figure 23:
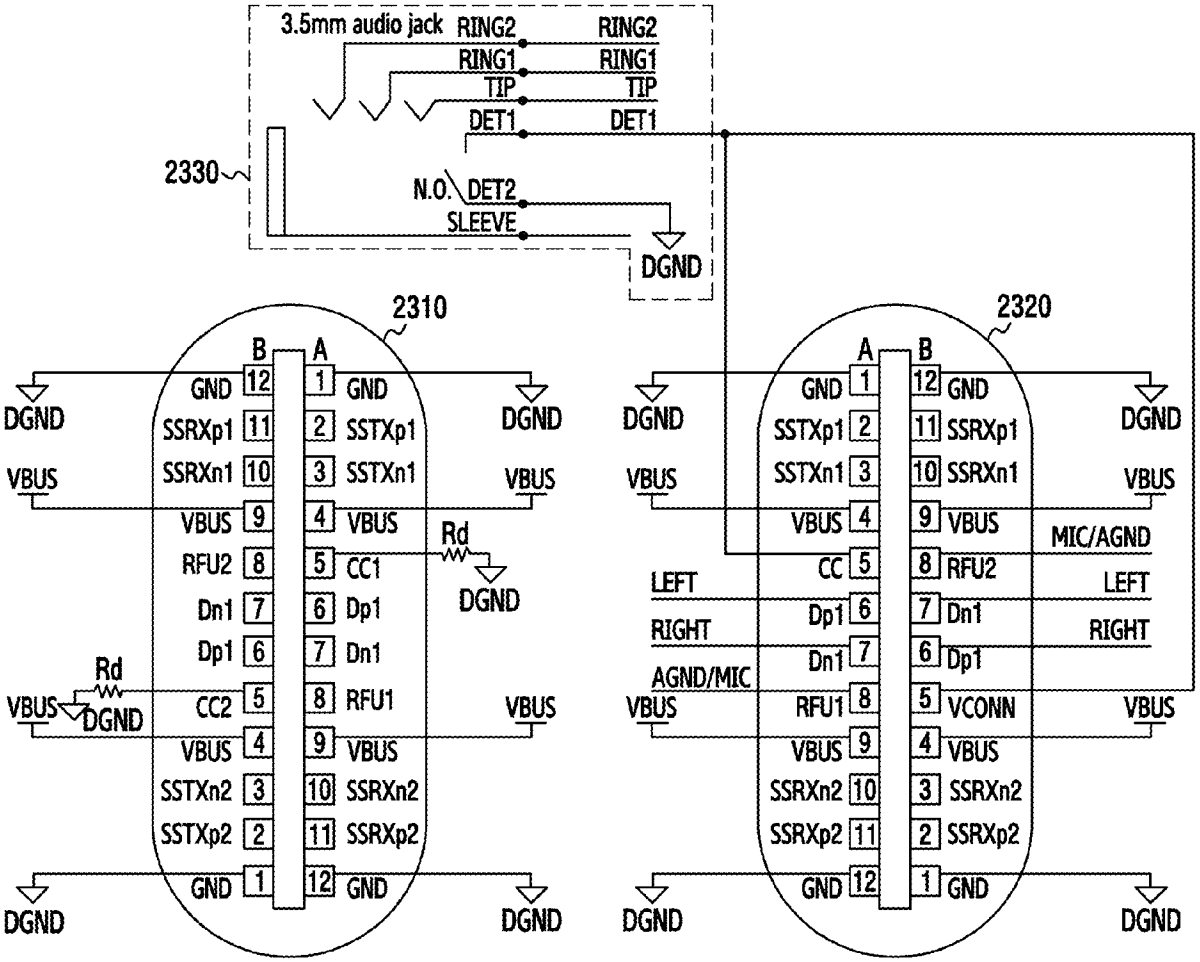

FIGS. 22 and 23 depict audio signal and power transmission and reception in an electronic device according to an embodiment of the present disclosure.

Referring to FIGS. 22 and 23, an electronic device 2201 is connected with an external connector 2202 through a receptacle 2210. For example, as the receptacle 2210 and a plug 2220 are connected, the electronic device 2201 and the external connector 2202 may be connected.

The external connector 2202 may be included in a charging device 2205. For example, when the external connector 2202 is configured, a separate charging device may be connected to the charging device 2205 through an interface of the external connector 2202. The external connector 2202 may include a controller 2223 for controlling audio signals and power.

The external connector 2202 may further include a plug 2221 for connecting to an ear jack 2230 (or an audio jack) of an earphone 2203. The ear jack 2230 may include, but is not limited to, a 3.5 mm ear jack. The earphone 2203 is depicted in FIG. 22, but the present disclosure is not limited to the earphone 2203. For example, the present disclosure may employ any device capable of inputting and outputting audio signals, including a speaker for outputting audio signals.

The electronic device 2202 may transceive audio signals with the earphone 2203 and concurrently receive power from the charging device 2205.

Referring to FIG. 23, when a plug 2320 of the external connector 2202 is inserted into a receptacle 2310 of the electronic device 2201, the electronic device 2201 may receive the power through at least one of the VBUS ports A4, B4, A9, and B9. The electronic device 2201 may receive current below 500 mA from the charging device 2205.

When the plug 2320 of the external connector 2202 is inserted into the receptacle 2310 of the electronic device 2201 and an ear jack 2330 is connected to the external connector 2202, the earphone 2203 may receive an audio signal from the electronic device 2201. For example, when the ear jack 2330 is a 3.5 mm ear jack (or a 3.5 mm audio jack) and a DET 2 contact of the ear jack 2330 meets a DET 1 contact of the plug 2320 of the external connector 2202, the electronic device 2201 may obtain a CC signal received through the CC port or the VCONN port of the plug 2320. Hence, the electronic device 2201 may detect that the earphone 2203 (or ear jack) is connected to the external connector 2202.

The electronic device 2201 may send the audio signal to the external connector 2202 and thus output the audio signal to the earphone 2203 connected to the external connector 2202.

The audio signal output to the earphone 2203 and the power reception from the charging device 2205 may be conducted independently. For example, when the electronic device 2201 outputs the audio signal to the earphone 2203 and concurrently receives the power from the charging device 2205 and the earphone 2203 is detached, the electronic device 2201 may continue the power reception from the charging device 2205. For example, when the electronic device 2201 outputs the audio signal to the earphone 2203 and concurrently receives the power from the charging device 2205 and the charging device 2205 is detached, the electronic device 2201 may continue the audio signal output to the earphone 2203.

Figure 24:
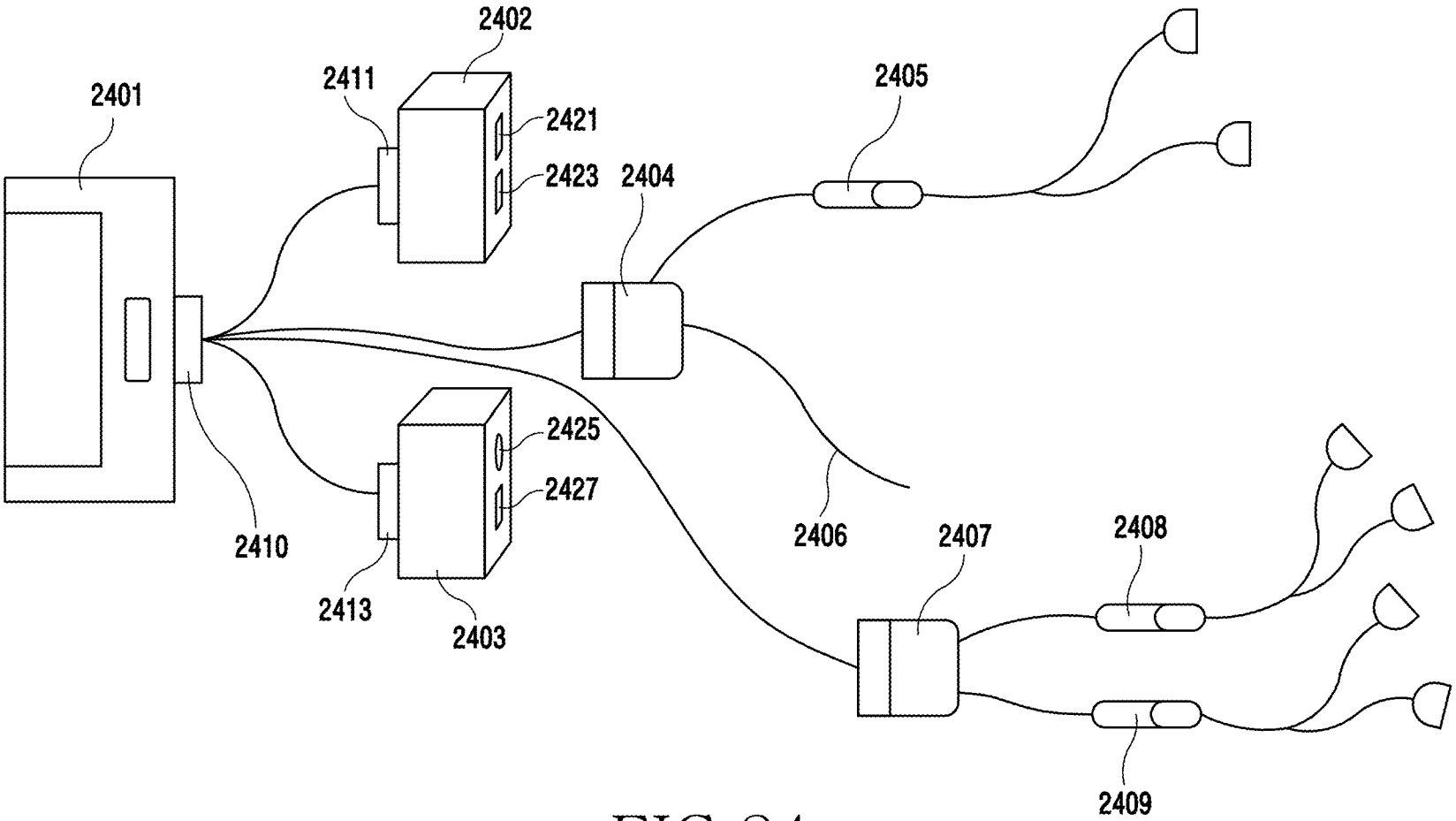
FIG. 24 is a diagram of an external connector which is configured according to an embodiment of the present disclosure.

FIG. 24 is a diagram of an external connector which is configured according to an embodiment of the present disclosure.

The external connector may be implemented using various genders. For example, the external connector may be implemented using a hub-type splitter. For example, an external connector 2402 may include, but is not limited to, a plug 2411 connected to a receptacle 2410 of an electronic device 2401, a receptacle 2421 for transceiving USB 3.1 Type-C audio signals, and a receptacle 2423 for transceiving USB 3.1 Type-C power. For example, an external connector 2403 may include, but is not limited to, a plug 2413, a receptacle 2425 of a 3.5 TRRS (or 3.5 mm pin) ear jack, and a receptacle 2427 for transceiving USB 3.1 Type-C power.

An external connector 2404 may be implemented using an ear-jack integrated splitter. For example, the external connector 2404, as a Y-shaped cable, may include receptacles (or ports) connected to the earphone 2405 and connected to a charging cable (or a charging device) 2406.

According to an embodiment of the present disclosure, the external connector 2407 may be configured to support dual channel stereo audio and 4-channel audio. For example, the external connector 2407 may be implemented using an ear-jack integrated splitter connected with two earphones 2408 and 2409. For example, the external connector 2407, as a Y-shaped cable, may include receptacles (or ports) connected to the earphone 2408 and the earphone 2409.

Figure 25B:
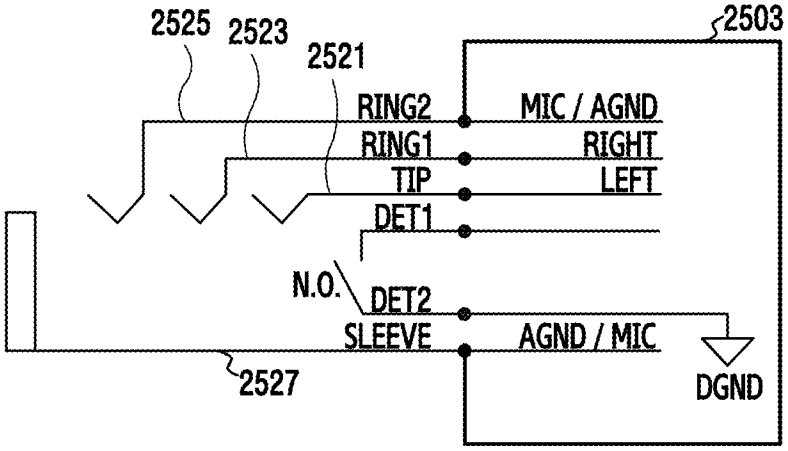
FIGS. 25A and 25B are diagrams of an external connector which is configured according to an embodiment of the present disclosure of the present disclosure.
Figure 25A:
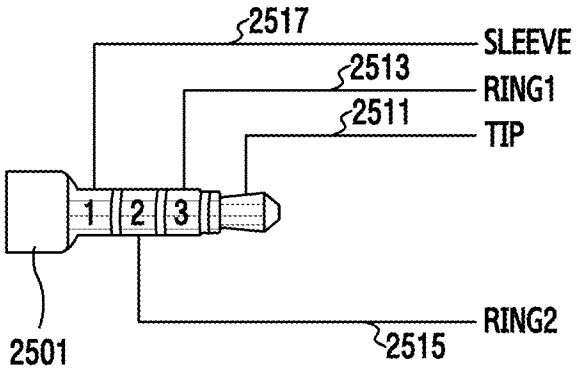

FIGS. 25A and 25B are diagrams of an external connector which is configured according to an embodiment of the present disclosure of the present disclosure.

FIG. 25A depicts a 3.5 mm TRRS headphone (or ear plug) 2501 supporting balanced audio signal transmission and reception, and FIG. 25B depicts an ear jack splitter 2503 of an external connector.

The ear jack splitter 2503 of the external connector may receive and forward an unbalanced audio signal to the 3.5 mm TRRS headphone 2501 supporting the balanced audio signal transmission and reception.

For example, the unbalanced audio (e.g., right, left) may be transceived through four poles of the 3.5 mm TRRS headphone 2501, for example, a tip 2511, a first ring 2513, a second ring 2515, and a sleeve 2517.

When the 3.5 mm TRRS headphone 2501 contacts (or connects to) the ear-jack splitter 2503 of the external connector, a second ring 2525 and a sleeve 2527 of four ports 2521 through 2527 of the ear jack splitter 2503 of the external connector are shorted (or grounded). Hence, the tip 2511 and the first ring 2513 of the 3.5 mm TRRS headphone 2501 may receive right and left unbalanced audio signals from the tip 2521 and the first ring 2523 of the ear jack splitter 2503 of the external connector and forward the signals to the 3.5 mm TRRS headphone 2501 supporting the balanced audio signal transmission and reception.

As set forth above, the audio signal controlling method and the electronic device supporting the same may support not only the unbalanced audio signal output but also the balanced audio signal output and thus reduce crosstalk and total harmonic distortion (THD). Also, the audio signal controlling method and the electronic device supporting the same may support the simultaneous output of the balanced audio signal and the microphone signal. In addition, the audio signal controlling method and the electronic device supporting the same may identify various audio adaptor accessories. Further, the audio signal controlling method and the electronic device supporting the same may support the dual channel stereo audio signal output or the 4-channel audio signal output. The audio signal controlling method and the electronic device supporting the same may provide a USB/audio signal switch structure which is simplified and capable of preventing performance degradation.

The above embodiments of the present disclosure may also be implemented as a computer program executed in a computer and may be implemented in a general digital computer which executes the program using a non-transitory computer-readable medium. A data structure used in the above embodiments may be recorded on the computer-readable medium via various means. The computer-readable medium includes storage media such as magnetic storage media (e.g., a read only memory (ROM), floppy disks, hard disks, etc.) and optical recording media (e.g., a compact disc (CD)-ROM, a digital versatile disc (DVD), etc.).

While the present disclosure has been particularly shown and described with reference to embodiments thereof, it will be understood by those of ordinary skill in the art that various changes in form and details may be made therein without departing from the spirit and scope of the disclosure as defined by the appended claims and their equivalents. The embodiments should be considered in a descriptive sense only and not for purposes of limitation. Therefore, the scope of the disclosure is defined not by the detailed description of the disclosure but by the appended claims and their equivalents, and all differences within the scope will be construed as being included in the present disclosure.

What is claimed is:

1. An electronic device comprising:

a housing;

an opening formed on a side of the housing;

a hole connected to the opening;

a receptacle disposed inside the hole, having a structure for receiving an external connector, and comprising a plurality of pins;

a memory;

a processor electrically coupled to the memory; and a circuit electrically coupled to the processor and the receptacle, wherein the processor is configured to:

receive, from the external connector, a signal and a current through the plurality of pins using the circuit, wherein the external connector is connected to an external device;

determine, based on the signal and the current, whether the external device provides an analog signal or a digital signal through the external connector, and a connection direction of the external device;

in response to determining that the external device provides the analog signal, determine, based on the signal and the current, a type of the external device;

set, based on the determined type of the external device, the plurality of pins of the receptacle corresponding to the external device providing the analog signal; and in response to determining that the external device provides the digital signal, set, based on the connection direction of the external device, the plurality of pins of the receptacle corresponding to the external device providing the digital signal.

2. The electronic device of claim 1, wherein the memory stores instructions, which when executed, cause the processor to:

select, based on the signal and the current, one of a plurality of audio signal processing methods, the plurality of audio signal processing methods being provided to the external connector;

process an audio signal according to the selected audio signal processing method; and provide the processed audio signal to the external connector through the receptacle.

3. The electronic device of claim 2, wherein the external connector is wired to an external audio device comprising a first speaker and a second speaker, and the instructions, when executed, cause the processor to provide the processed audio signal to the first speaker and the second speaker through two pins among the plurality of pins.

4. The electronic device of claim 3, wherein, in response to detecting that the external connector is inserted into the receptacle, the instructions, when executed, cause the processor to, using the circuit, receive another audio signal from the external audio device through another one of the plurality of pins.

5. The electronic device of claim 2, wherein the external device comprises a first speaker and a second speaker, and wherein, in response to detecting that the external connector is inserted, the instructions, when executed, cause the processor to:

electrically connect two pins and two other pins among the plurality of pins, wherein the two other pins are symmetrical to the two pins in at least one orientation, and provide the processed audio signal to the first speaker and the second speaker through the two pins and the two other pins.

6. The electronic device of claim 3, wherein the two pins are disposed in proximity.

7. The electronic device of claim 2, wherein the external connector is wired to an external audio device comprising a first speaker and a second speaker, and the instructions, when executed, cause the processor to:

provide a first audio output to the first speaker through a first pin of the pins and a second pin which is symmetrical to the first pin in at least one orientation, and provide a second audio output to the second speaker through a third pin of the pins and a fourth pin which is symmetrical to the third pin in at least one orientation.

8. The electronic device of claim 7, wherein the first audio output comprises a first audio output signal provided to the first speaker through the first pin and a second audio output signal provided to the first speaker through the second pin, and wherein the first audio output signal is a phase-inverted signal of the second audio output signal.

9. The electronic device of claim 2, wherein the instructions, when executed, cause the processor to:

measure, using the circuit, an impedance of at least one of the plurality of pins based on at least one of the received signal or the current, and select, using the current, one of the plurality of audio signal processing methods based on at least part of the measured impedance.

10. The electronic device of claim 2, wherein the instructions, when executed, cause the processor to:

obtain, using the circuit, identification information of the external connector based on at least one of the received signal or the current, and select, using the circuit, one of the plurality of audio signal processing methods based on at least part of the obtained identification information, wherein the identification information comprises at least one of an audio output method, a type, a vendor, or a unique number of the external connector.

11. A method in an electronic device comprising:

receiving, from an external connector, a signal and a current through a plurality of pins of a receptacle of the electronic device using a circuit which is coupled to the receptacle;

determining, based on the signal and the current, whether the external device provides an analog signal or a digital signal through the external connector, and a connection direction of the external device;

in response to determining that the external device provides the analog signal, determining, based on the signal and the current, a type of the external device;

setting, based on the determined type of the external device, the plurality of pins of the receptacle corresponding to the external device providing the analog signal; and in response to determining that the external device provides the digital signal, setting, based on the connection direction of the external device, the plurality of pins of the receptacle corresponding to the external device providing the digital signal.

12. The method of claim 11, further comprising:

selecting, based on the signal and the current, one of a plurality of audio signal processing methods, the plurality of audio signal processing methods being provided to the external connector;

processing an audio signal according to the selected audio signal processing method; and providing the processed audio signal to the external connector through the receptacle.

13. The method of claim 12, wherein the external connector is wired to an external audio device comprising a first speaker and a second speaker, and further comprising:

providing the processed audio signal to the first speaker and the second speaker through two pins among the plurality of pins.

14. The method of claim 13, further comprising:

in response to detecting that the external connector is inserted into the receptacle, receiving another audio signal from the external audio device through another one of the plurality of pins.

15. The method of claim 11, wherein the external device comprises a first speaker and a second speaker, and further comprising:

in response to detecting that the external connector is inserted, electrically connecting two pins and two other pins among the plurality of pins, wherein the two other pins are symmetrical to the two pins in at least one orientation, and providing the processed audio signal to the first speaker and the second speaker through the two pins and the two other pins.

16. The method of claim 13, wherein the two pins are disposed in proximity.

17. The method of claim 12, wherein the external connector is wired to an external audio device comprising a first speaker and a second speaker, and further comprising:

providing a first audio output to the first speaker through a first pin of the pins and a second pin which is symmetrical to the first pin in at least one orientation, and providing a second audio output to the second speaker through a third pin of the pins and a fourth pin which is symmetrical to the third pin in at least one orientation.

18. The method of claim 17, wherein the first audio output comprises a first audio output signal provided to the first speaker through the first pin and a second audio output signal provided to the first speaker through the second pin, and wherein the first audio output signal is a phase-inverted signal of the second audio output signal.

19. The method of claim 11, further comprising:

measuring an impedance of at least one of the plurality of pins based on at least one of the received signal or the current; and selecting one of the plurality of audio signal processing methods based on at least part of the measured impedance.

20. The method of claim 11, further comprising:

obtaining identification information of the external connector based on at least one of the received signal or the current; and selecting one of the plurality of audio signal processing methods based on at least part of the obtained identification information, wherein the identification information comprises at least one of an audio output method, a type, a vendor, or a unique number of the external connector.

* * * * *